US010675869B2

(12) United States Patent
Kameyama et al.

(10) Patent No.: US 10,675,869 B2
(45) Date of Patent: Jun. 9, 2020

(54) HEAD CHIP, LIQUID JET HEAD AND LIQUID JET RECORDING DEVICE

(71) Applicant: SII Printek Inc., Chiba-shi, Chiba (JP)

(72) Inventors: Tomoki Kameyama, Chiba (JP); Yuki Yamamura, Chiba (JP); Daichi Nishikawa, Chiba (JP); Misaki Kobayashi, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 16/185,914

(22) Filed: Nov. 9, 2018

(65) Prior Publication Data

US 2019/0143689 A1 May 16, 2019

(30) Foreign Application Priority Data

Nov. 13, 2017 (JP) ..... 2017-218097

(51) Int. Cl.
*B41J 2/14* (2006.01)
*B41J 2/165* (2006.01)

(52) U.S. Cl.
CPC ..... *B41J 2/14201* (2013.01); *B41J 2/14072* (2013.01); *B41J 2/14209* (2013.01); *B41J 2/16505* (2013.01); *B41J 2002/14491* (2013.01)

(58) Field of Classification Search
CPC ..... B41J 2/14201; B41J 2/14072; B41J 2/14209; B41J 2/16505; B41J 2/14282; B41J 2002/14217; B41J 2002/14225; B41J 2002/14241; B41J 2002/14258; B41J 2002/14306
See application file for complete search history.

(56) References Cited

U.S. PATENT DOCUMENTS 9,283,758 B2 * 3/2016 Horiguchi ..... B41J 2/14201
9,566,786 B2 2/2017 Brook et al.

* cited by examiner

*Primary Examiner* — Juanita D Jackson
(74) *Attorney, Agent, or Firm* — Brinks Gilson & Lione

(57) ABSTRACT

A head chip, a liquid jet head, and a liquid jet recording device capable of achieving the miniaturization while enhancing the reliability are provided. The head chip according to an embodiment of the disclosure includes an actuator plate having a plurality of ejection grooves arranged side by side in a first direction, a plurality of non-ejection grooves arranged side by side along the first direction, and individual electrodes respectively formed in the plurality of non-ejection grooves, a nozzle plate having a plurality of nozzle holes individually communicated with the plurality of ejection grooves, and a cover plate adapted to cover the actuator plate. The cover plate has interconnection connecting sections respectively disposed in end part areas along a second direction perpendicular to the first direction, and adapted to electrically connect a plurality of individual interconnections electrically connected to the individual electrodes to an interconnection board outside the head chip. The plurality of individual interconnections in the interconnection connecting section has a bend part extending in an oblique direction crossing the second direction so as to circumvent a predetermined obstacle. A connection area between the plurality of individual interconnections and the interconnection board in the interconnection connecting section is an area including the bend part.

8 Claims, 13 Drawing Sheets

HEAD CHIP, LIQUID JET HEAD AND LIQUID JET RECORDING DEVICE

This application claims priority under 35 U.S.C. § 119 to Japanese Patent Application No. 2017-218097 filed on Nov. 13, 2017, the entire content of which is hereby incorporated by reference.

BACKGROUND OF THE INVENTION

1. Field of the Invention

The present disclosure relates to a head chip, a liquid jet head and a liquid jet recording device.

2. Description of the Related Art

As one of liquid jet recording devices, there is provided an inkjet type recording device for ejecting (jetting) ink (liquid) on a recording target medium such as recording paper to perform recording of images, characters, and so on (see, e.g., the specification of U.S. Pat. No. 9,566,786).

In the liquid jet recording device of this type, it is arranged that the ink is supplied from an ink tank to an inkjet head (a liquid jet head), and then the ink is ejected from nozzle holes of the inkjet head toward the recording target medium to thereby perform recording of the images, the characters, and so on. Further, such an inkjet head is provided with a head chip for ejecting the ink.

In such a head chip or the like, in general, it is required to enhance the reliability, and to achieve miniaturization of the chip size. It is desirable to provide a head chip, a liquid jet head, and a liquid jet recording device capable of achieving the miniaturization while enhancing the reliability.

SUMMARY OF THE INVENTION

The head chip according to an embodiment of the disclosure includes an actuator plate having a plurality of ejection grooves arranged side by side in a first direction, a plurality of non-ejection grooves arranged side by side along the first direction, and individual electrodes respectively formed in the plurality of non-ejection grooves, a nozzle plate having a plurality of nozzle holes individually communicated with the plurality of ejection grooves, and a cover plate adapted to cover the actuator plate. The cover plate has interconnection connecting sections respectively disposed in end part areas along a second direction perpendicular to the first direction, and adapted to electrically connect a plurality of individual interconnections electrically connected to the individual electrodes to an interconnection board outside the head chip. The plurality of individual interconnections in the interconnection connecting section has a bend part extending in an oblique direction crossing the second direction so as to circumvent a predetermined obstacle. A connection area between the plurality of individual interconnections and the interconnection board in the interconnection connecting section is an area including the bend part.

A liquid jet head according to an embodiment of the disclosure is equipped with the head chip according to an embodiment of the disclosure.

A liquid jet recording device according to an embodiment of the disclosure is equipped with the liquid jet head according to an embodiment of the disclosure, and a containing section adapted to contain the liquid.

According to the head chip, the liquid jet head and the liquid jet recording device related to an embodiment of the disclosure, it becomes possible to achieve the miniaturization while enhancing the reliability.

DETAILED DESCRIPTION OF THE PREFERRED EMBODIMENTS

An embodiment of the present disclosure will hereinafter be described in detail with reference to the drawings. It should be noted that the description will be presented in the following order.

1. Embodiment (an example in which a connection area in an interconnection connecting section includes both of a bend part and a straight part)
2. Modified Example (an example in which the connection area in the interconnection connecting section includes only the bend part)
3. Other Modified Examples 1. Embodiment

[Overall Configuration of Printer 1]

Figure 1:
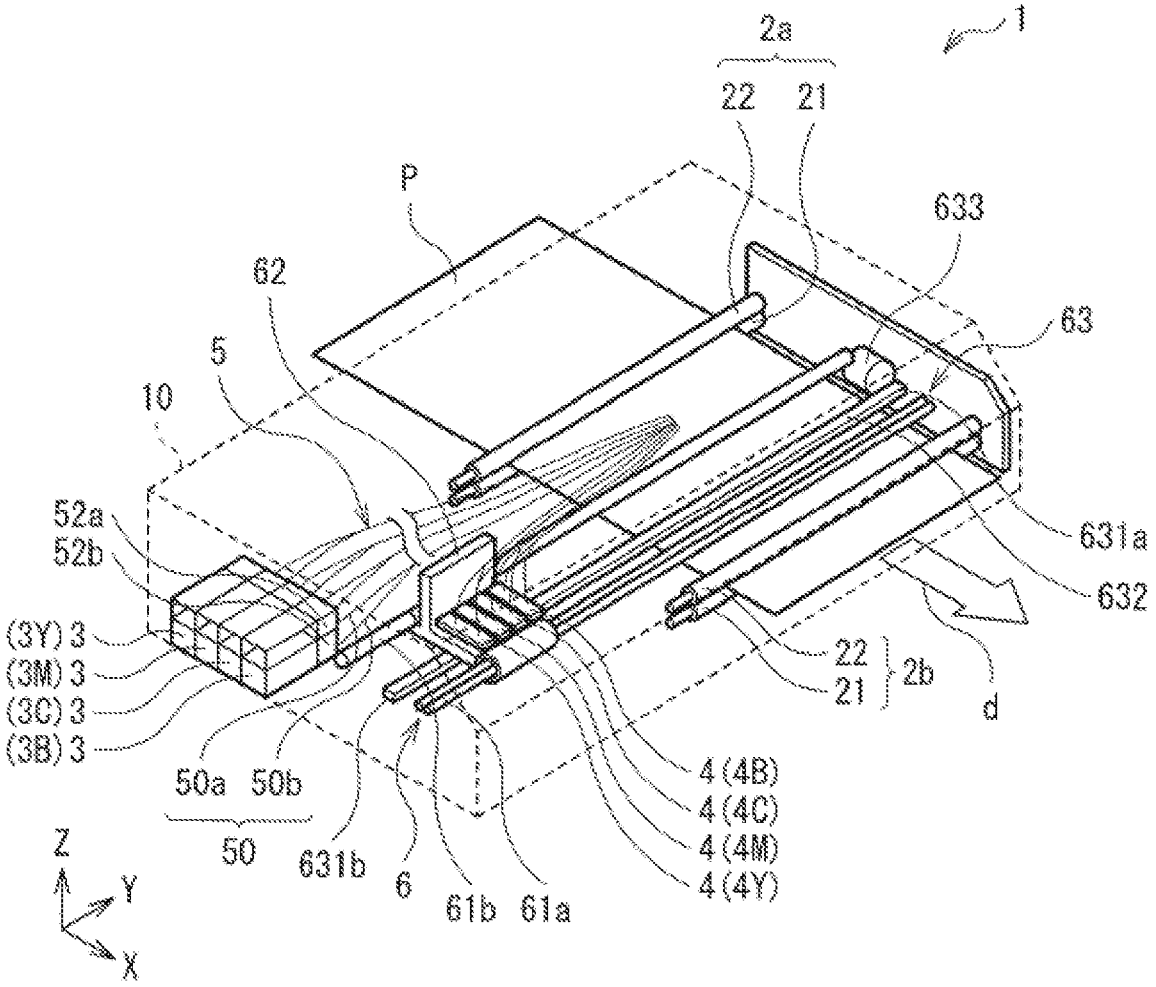
FIG. 1 is a schematic perspective view showing a schematic configuration example of a liquid jet recording device according to one embodiment of the disclosure.

FIG. 1 is a perspective view schematically showing a schematic configuration example of a printer 1 as a liquid jet recording device according to one embodiment of the present disclosure. The printer 1 is an inkjet printer for performing recording (printing) of images, characters, and so on, on recording paper P as a recording target medium using ink 9 described later.

As shown in FIG. 1, the printer 1 is provided with a pair of carrying mechanisms 2*a*, 2*b*, ink tanks 3, inkjet heads 4, a circulation mechanism 5, and a scanning mechanism 6. These members are housed in a housing 10 having a predetermined shape. It should be noted that the scale size of each member is accordingly altered so that the member is shown large enough to recognize in the drawings used in the description of the specification.

Here, the printer 1 corresponds to a specific example of the "liquid jet recording device" in the present disclosure, and the inkjet heads 4 (the inkjet heads 4Y, 4M, 4C, and 4B described later) each correspond to a specific example of a "liquid jet head" in the present disclosure. Further, the ink 9 corresponds to a specific example of the "liquid" in the present disclosure.

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grit roller 21, a pinch roller 22 and a drive mechanism (not shown). The grit roller 21 and the pinch roller 22 are each disposed so as to extend along a Y-axis direction (the width direction of the recording paper P). The drive mechanism is a mechanism for rotating (rotating in a Z-X plane) the grit roller 21 around an axis, and is constituted by, for example, a motor.

(Ink Tanks 3)

The ink tanks 3 are each a tank for containing the ink 9 inside. As the ink tanks 3, there are disposed 4 types of tanks for individually containing 4 colors of ink 9, namely yellow (Y), magenta (M), cyan (C), and black (B), in this example as shown in FIG. 1. Specifically, there are disposed the ink tank 3Y for containing the yellow ink 9, the ink tank 3M for containing the magenta ink 9, the ink tank 3C for containing the cyan ink 9, and the ink tank 3B for containing the black ink 9. These ink tanks 3Y, 3M, 3C, and 3B are arranged side by side along the X-axis direction inside the housing 10.

It should be noted that the ink tanks 3Y, 3M, 3C, and 3B have the same configuration except the color of the ink 9 contained, and are therefore collectively referred to as ink tanks 3 in the following description. Further, the ink tanks 3 (3Y, 3M, 3C, and 3B) correspond to an example of a "containing section" in the present disclosure.

(Inkjet Heads 4)

The inkjet heads 4 are each a head for jetting (ejecting) the ink 9 having a droplet shape from a plurality of nozzles (nozzle holes H1, H2) described later to the recording paper P to thereby perform recording of images, characters, and so on. As the inkjet heads 4, there are also disposed 4 types of heads for individually jetting the 4 colors of ink 9 respectively contained by the ink tanks 3Y, 3M, 3C, and 3B described above in this example as shown in FIG. 1. Specifically, there are disposed the inkjet head 4Y for jetting the yellow ink 9, the inkjet head 4M for jetting the magenta ink 9, the inkjet head 4C for jetting the cyan ink 9, and the inkjet head 4B for jetting the black ink 9. These inkjet heads 4Y, 4M, 4C, and 4B are arranged side by side along the Y-axis direction in the housing 10.

It should be noted that the inkjet heads 4Y, 4M, 4C, and 4B have the same configuration except the color of the ink 9 used, and are therefore collectively referred to as inkjet heads 4 in the following description. Further, the detailed configuration of the inkjet heads 4 will be described later (FIG. 2 through FIG. 6).

(Circulation Mechanism 5)

The circulation mechanism 5 is a mechanism for circulating the ink 9 between the inside of the ink tanks 3 and the inside of the inkjet heads 4. The circulation mechanism 5 is configured including, for example, circulation channels 50 as flow channels for circulating the ink 9, and pairs of liquid feeding pumps 52*a*, 52*b*.

As shown in FIG. 1, the circulation channels 50 each have a flow channel 50*a* as a part extending from the ink tank 3 to reach the inkjet head 4 via the liquid feeding pump 52*a*, and a flow channel 50*b* as a part extending from the inkjet head 4 to reach the ink tank 3 via the liquid feeding pump 52*b*. In other words, the flow channel 50*a* is a flow channel through which the ink 9 flows from the ink tank 3 toward the inkjet head 4. Further, the flow channel 50*b* is a flow channel through which the ink 9 flows from the inkjet head 4 toward the ink tank 3. It should be noted that these flow channels 50*a*, 50*b* (supply tubes of the ink 9) are each formed of a flexible hose having flexibility.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction. Further, the drive mechanism 63 is provided with a pair of pulleys 631*a*, 631*b* disposed between the pair of guide rails 61*a*, 61*b*, an endless belt 632 wound between the pair of pulleys 631*a*, 631*b*, and a drive motor 633 for rotationally driving the pulley 631*a*.

The pulleys 631*a*, 631*b* are respectively disposed in areas corresponding to the vicinities of both ends in each of the guide rails 61*a*, 61*b* along the Y-axis direction. To the endless belt 632, there is connected the carriage 62. On the carriage 62, there are disposed the four types of inkjet heads 4Y, 4M, 4C, and 4B arranged side by side along the Y-axis direction.

It should be noted that it is arranged that a moving mechanism for moving the inkjet heads 4 relatively to the recording paper P is constituted by such a scanning mechanism 6 and the carrying mechanisms 2*a*, 2*b* described above.

[Detailed Configuration of Inkjet Heads 4]

Then, the detailed configuration example of the inkjet heads 4 (head chips 41) will be described with reference to FIG. 2 through FIG. 6, in addition to FIG. 1.

Figure 2:
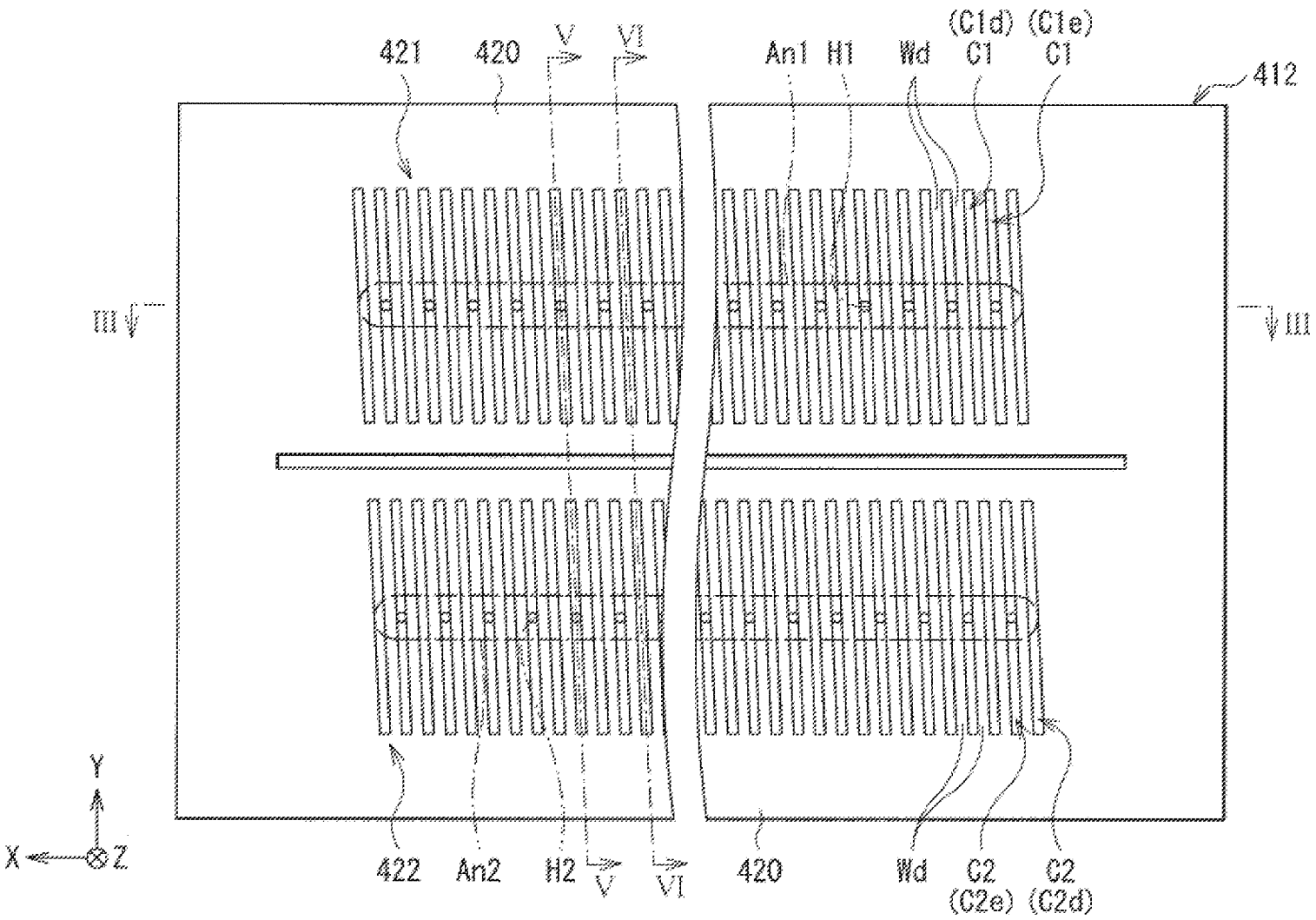
FIG. 2 is a perspective bottom view showing a configuration example of a substantial part of the liquid jet head shown in FIG. 1.
Figure 3:
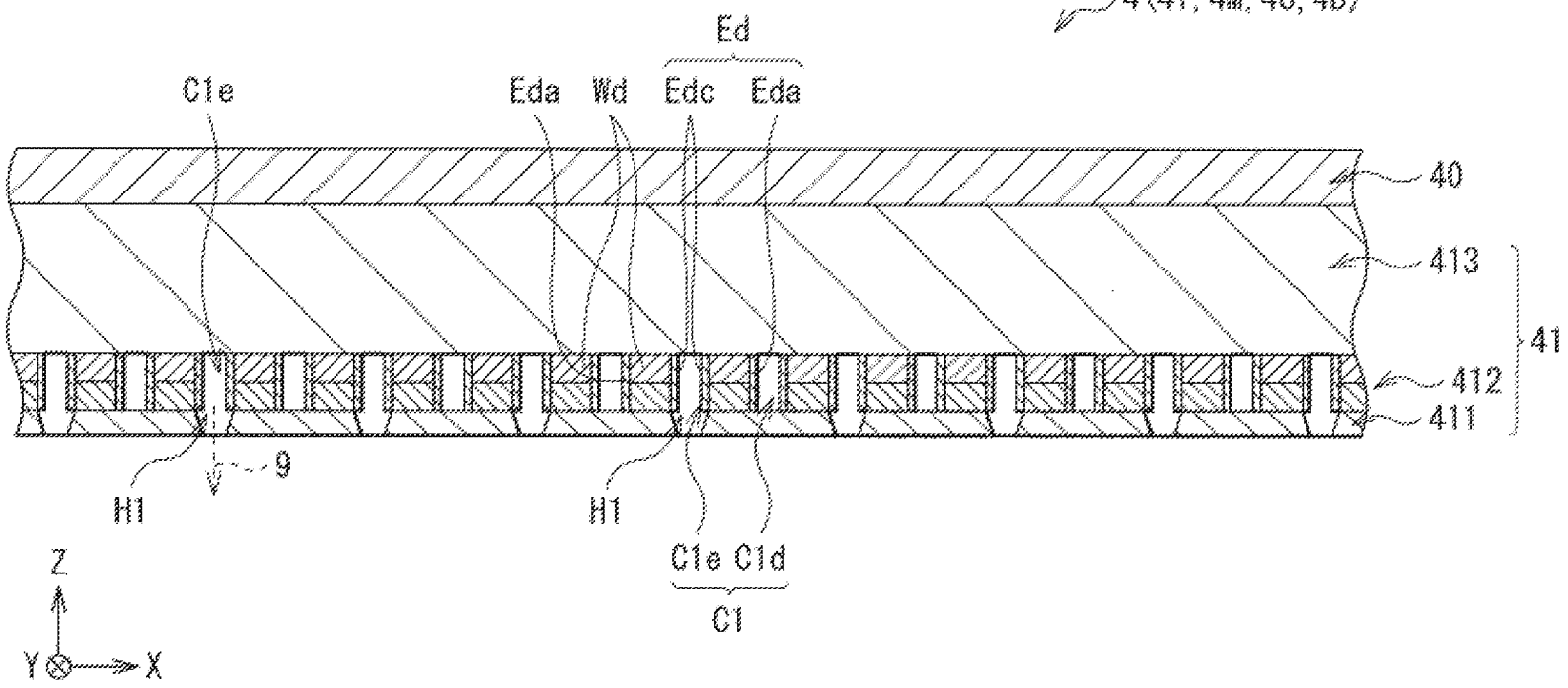
FIG. 3 is a schematic diagram showing a cross-sectional configuration example along the line in the head chip shown in FIG. 2.
Figure 4:
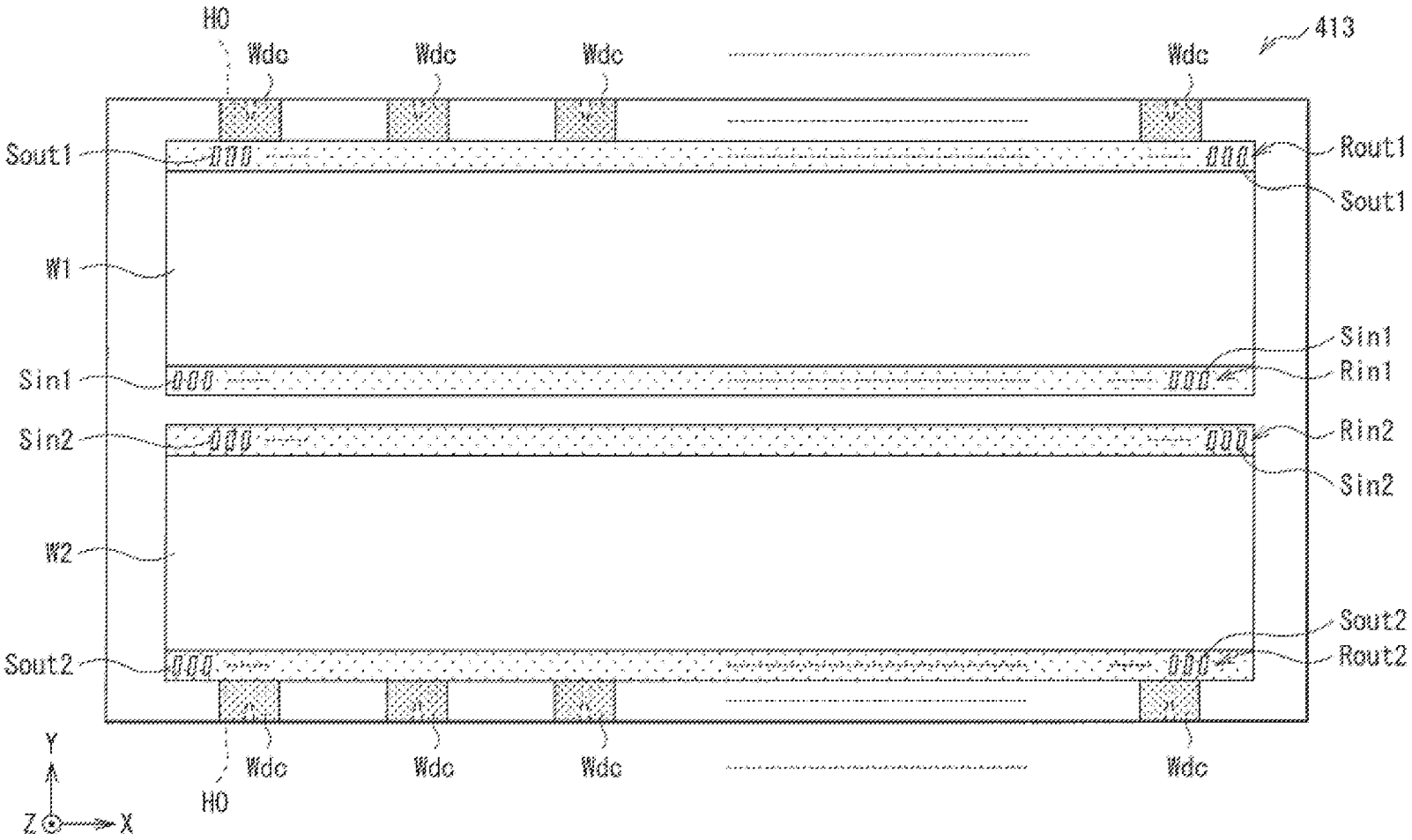
FIG. 4 is a schematic diagram showing a top surface configuration example of the cover plate shown in FIG. 3.
Figure 5:
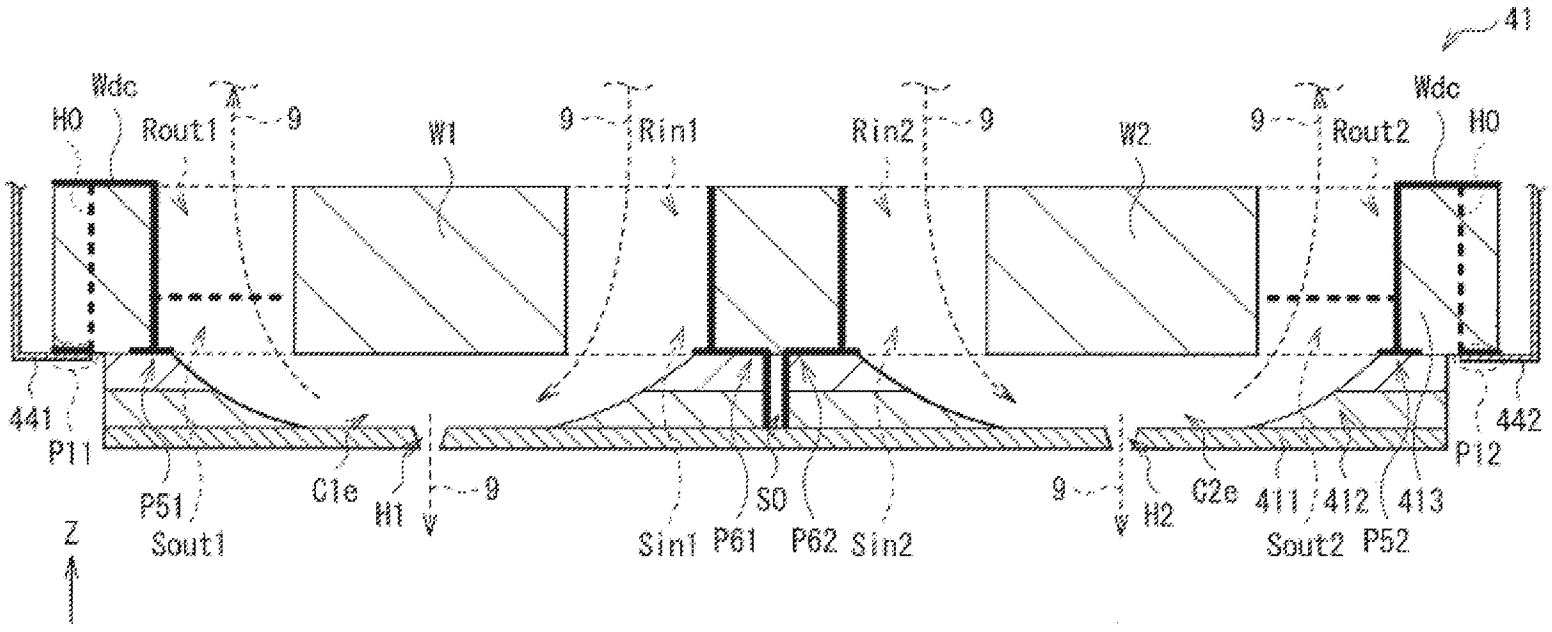
FIG. 5 is a schematic diagram showing a cross-sectional configuration example of the head chip along the line V-V shown in FIG. 2.
Figure 6:
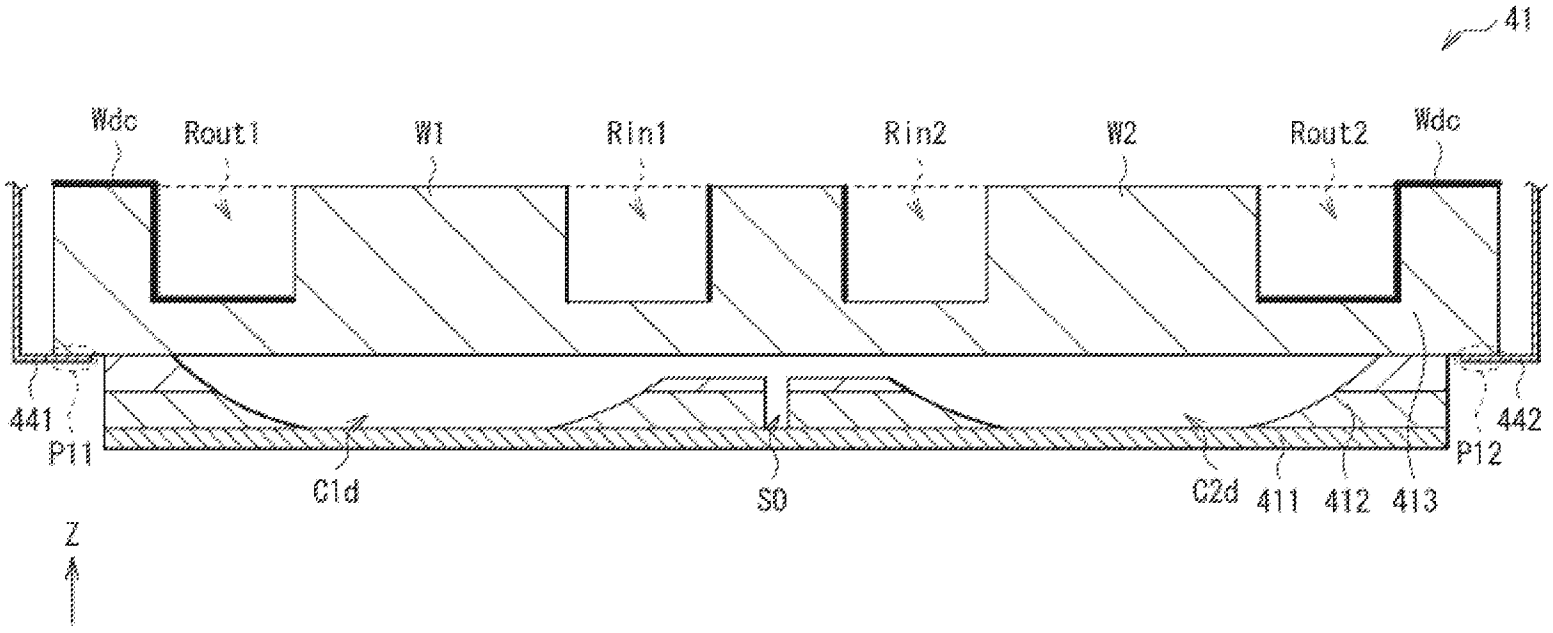
FIG. 6 is a schematic diagram showing a cross-sectional configuration example of the head chip along the line VI-VI shown in FIG. 2.

FIG. 2 is a diagram schematically showing a bottom view (an X-Y bottom view) of a configuration example of a substantial part of the inkjet head 4 in the state in which a nozzle plate 411 (described later) is removed. FIG. 3 is a diagram schematically showing a cross-sectional configuration example (a Z-X cross-sectional configuration example) of the inkjet head 4 along the line shown in FIG. 2. FIG. 4 is a diagram schematically showing a top surface configuration example (an X-Y top surface configuration example) of a cover plate 413 (described later) shown in FIG. 3. FIG. 5 is a diagram schematically showing a cross-sectional configuration example of the inkjet head 4 along the line V-V shown in FIG. 2, and corresponds to a cross-sectional configuration example of a vicinity of ejection channels C1*e*, C2*e* (ejection grooves) in the head chip 41 described later. Further, FIG. 6 is a diagram schematically showing a cross-sectional configuration example of the inkjet head 4 along the line VI-VI shown in FIG. 2, and corresponds to a cross-sectional configuration example of a vicinity of dummy channels C1*d*, C2*d* (non-ejection grooves) in the head chip 41 described later.

The inkjet heads 4 according to the present embodiment are each an inkjet head of a so-called side-shoot type for ejecting the ink 9 from a central part in an extending direction (an oblique direction described later) of a plurality of channels (a plurality of channels C1 and a plurality of channels C2) in the head chip 41 described later. Further, the inkjet heads 4 are each an inkjet head of a circulation type which uses the circulation mechanism 5 (the circulation channel 50) described above to thereby use the ink 9 while circulated between the inkjet head 4 and the ink tank 3.

As shown in FIG. 3, the inkjet heads 4 are each provided with the head chip 41 and a flow channel plate 40. Further, the inkjet heads 4 are each provided with a circuit board (not shown) and flexible printed circuit boards (FPC) 441, 442 described later as a control mechanism (a mechanism for controlling the operation of the head chip 41).

The circuit board is a board for mounting a drive circuit (an electric circuit) for driving the head chip 41. Although the details will be described later (see FIG. 6 and FIG. 7), the flexible printed circuit boards 441, 442 are each a board for providing electrical connections between the drive circuit on the circuit board and drive electrodes Ed described later in the head chip 41. It should be noted that it is arranged that such flexible printed circuit boards 441, 442 are each provided with a plurality of extraction electrodes described later as printed wiring.

As shown in FIG. 3, the head chip 41 is a member for jetting the ink 9 along the Z-axis direction, and is configured using a variety of types of plates. Specifically, as shown in FIG. 3, the head chip 41 is mainly provided with a nozzle plate (a jet hole plate) 411, an actuator plate 412 and a cover plate 413. The nozzle plate 411, the actuator plate 412, the cover plate 413, and the flow channel plate 40 described above are bonded to each other using, for example, an adhesive, and are stacked on one another in this order along the Z-axis direction. It should be noted that the description will hereinafter be presented with the flow channel plate 40 side (the cover plate 413 side) along the Z-axis direction referred to as an upper side, and the nozzle plate 411 side referred to as a lower side.

(Nozzle Plate 411)

The nozzle plate 411 is formed of a film member made of polyimide or the like having a thickness of, for example, about 50 μm, and is bonded to a lower surface of the actuator plate 412 as shown in FIG. 3. It should be noted that the constituent material of the nozzle plate 411 is not limited to the resin material such as polyimide, but can also be, for example, a metal material. Further, as shown in FIG. 2, the nozzle plate 411 is provided with two nozzle columns (nozzle columns An1, An2) each extending along the X-axis direction. These nozzle columns An1, An2 are arranged along the Y-axis direction with a predetermined distance. As described above, the inkjet head 4 (the head chip 41) of the present embodiment is formed as a two-column type inkjet head (head chip).

The nozzle column An1 has a plurality of nozzle holes H1 formed so as to be arranged in a straight line at predetermined intervals along the X-axis direction. These nozzle holes H1 each penetrate the nozzle plate 411 along the thickness direction of the nozzle plate 411 (the Z-axis direction), and are communicated with the respective ejection channels C1*e* in the actuator plate 412 described later as shown in, for example, FIG. 3 and FIG. 5. Specifically, as shown in FIG. 2, each of the nozzle holes H1 is formed so as to be located in a central part along the extending direction (an oblique direction described later) of the ejection channels C1*e*. Further, the formation pitch along the X-axis direction in the nozzle holes H1 is arranged to be equal (to have an equal pitch) to the formation pitch along the X-axis direction in the ejection channels C1*e*. Although the details will be described later, it is arranged that the ink 9 supplied from the inside of the ejection channel C1*e* is ejected (jetted) from each of the nozzle holes H1 of such a nozzle column An1.

The nozzle column An2 similarly has a plurality of nozzle holes H2 formed so as to be arranged in a straight line at predetermined intervals along the X-axis direction. These nozzle holes H2 each penetrate the nozzle plate 411 along the thickness direction of the nozzle plate 411, and are communicated with the respective ejection channels C2*e* in the actuator plate 412 described later. Specifically, as shown in FIG. 2, each of the nozzle holes H2 is formed so as to be located in a central part along the extending direction (an oblique direction described later) of the ejection channels C2*e*. Further, the formation pitch along the X-axis direction in the nozzle holes H2 is arranged to be equal to the formation pitch along the X-axis direction in the ejection channels C2*e*. Although the details will be described later, it is arranged that the ink 9 supplied from the inside of the ejection channel C2*e* is also ejected from each of the nozzle holes H2 of such a nozzle column An2.

Further, as shown in FIG. 2, the nozzle holes H1 in the nozzle column An1 and the nozzle holes H2 in the nozzle column An2 are arranged in a staggered manner along the X-axis direction. Therefore, in each of the inkjet heads 4 according to the present embodiment, the nozzle holes H1 in the nozzle column An1 and the nozzle holes H2 in the nozzle column An2 are arranged in a zigzag manner. It should be noted that such nozzle holes H1, H2 each have a tapered through hole gradually decreasing in diameter toward the lower side.

(Actuator Plate 412)

The actuator plate 412 is a plate formed of a piezoelectric material such as lead zirconate titanate (PZT). As shown in FIG. 2, the actuator plate 412 is formed by stacking two piezoelectric substrates different in polarization direction from each other on one another along the thickness direction (the Z-axis direction) (a so-called chevron type). It should be noted that the configuration of the actuator plate 412 is not limited to the chevron type. Specifically, it is also possible to form the actuator plate 412 with, for example, a single (unique) piezoelectric substrate having the polarization direction set one direction along the thickness direction (the Z-axis direction) (a so-called cantilever type).

Further, as shown in FIG. 2, the actuator plate 412 is provided with two channel columns (channel columns 421, 422) each extending along the X-axis direction. These channel columns 421, 422 are arranged along the Y-axis direction with a predetermined distance.

In such an actuator plate 412, as shown in FIG. 2, an ejection area (jetting area) of the ink 9 is disposed in a central part (the formation areas of the channel columns 421, 422) along the X-axis direction. On the other hand, in the actuator plate 412, a non-ejection area (non-jetting area) of the ink 9 is disposed in each of the both end parts (non-formation areas of the channel columns 421, 422) along the X-axis direction. The non-ejection areas are located on the outer side along the X-axis direction with respect to the ejection area described above. It should be noted that the both end parts along the Y-axis direction in the actuator plate 412 each constitute a tail part 420 as shown in FIG. 2.

As shown in FIG. 2 and FIG. 3, the channel column 421 described above has a plurality of channels C1. As shown in FIG. 2, these channels C1 extend along an oblique direction forming a predetermined angle (an acute angle) with the Y-axis direction inside the actuator plate 412. Further, as shown in FIG. 2, these channels C1 are arranged side by side so as to be parallel to each other at predetermined intervals along the X-axis direction. Each of the channels C1 is partitioned with drive walls Wd formed of a piezoelectric body (the actuator plate 412), and forms a groove section having a recessed shape in a cross-sectional view (see FIG. 3).

As shown in FIG. 2, the channel column 422 similarly has a plurality of channels C2 extending along the oblique direction described above. As shown in FIG. 2, these channels C2 are arranged side by side so as to be parallel to each other at predetermined intervals along the X-axis direction. Each of the channels C2 is also partitioned with drive walls Wd described above, and forms a groove section having a recessed shape in a cross-sectional view.

Here, as shown in FIG. 2, FIG. 3, FIG. 5, and FIG. 6, in the channels C1, there exist ejection channels C1*e* (ejection grooves) for ejecting the ink 9, and dummy channels C1*d* (non-ejection grooves) not ejecting the ink 9. As shown in FIG. 2 and FIG. 3, in the channel column 421, the ejection channels C1*e* and the dummy channels C1*d* are alternately arranged along the X-axis direction. Further, each of the ejection channels C1*e* is communicated with the nozzle hole H1 in the nozzle plate 411 on the one hand, but each of the dummy channels C1*d* is not communicated with the nozzle hole H1, and is covered with an upper surface of the cover plate 411 from below on the other hand (see FIG. 3, FIG. 5 and FIG. 6).

Similarly, as shown in FIG. 2, FIG. 5 and FIG. 6, in the channels C2, there exist ejection channels C2*e* (ejection grooves) for ejecting the ink 9, and dummy channels C2*d* (non-ejection grooves) not ejecting the ink 9. As shown in FIG. 2, in the channel column 422, the ejection channels C2*e* and the dummy channels C2*d* are alternately arranged along the X-axis direction. Further, each of the ejection channels C2*e* is communicated with the nozzle hole H2 in the nozzle plate 411 on the one hand, but each of the dummy channels C2*d* is not communicated with the nozzle hole H2, and is covered with the upper surface of the cover plate 411 from below on the other hand (see FIG. 5 and FIG. 6).

It should be noted that such ejection channels C1*e*, C2*e* each correspond to one specific example of the "ejection groove" in the present disclosure. Further, the dummy channels C1*d*, C2*d* each correspond to one specific example of the "non-ejection groove" in the present disclosure.

Further, as indicated by the line V-V in FIG. 2, the ejection channels C1*e* in the channel column 421 and the ejection channel C2*e* in the channel column 422 are disposed in alignment with each other (see FIG. 5) along the extending direction (the oblique direction described above) of these ejection channels C1*e*, C2*e*. Similarly, as indicated by the line VI-VI in FIG. 2, the dummy channels C1*d* in the channel column 421 and the dummy channel C2*d* in the channel column 422 are disposed in alignment with each other (see FIG. 6) along the extending direction (the oblique direction described above) of these dummy channels C1*d*, C2*d*.

It should be noted that as shown in FIG. 5, the ejection channels C1*e*, C2*e* each have arc-like side surfaces with which the cross-sectional area of each of the ejection channels C1*e*, C2*e* gradually decreases in a direction from the cover plate 413 side (upper side) toward the nozzle plate 411 side (lower side). It is arranged that the arc-like side surfaces of such ejection channels C1*e*, C2*e* are each formed by, for example, cutting work using a dicer.

Here, as shown in FIG. 3, the drive electrode Ed extending along the oblique direction described above is disposed on each of the inside surfaces opposed to each other in the drive walls Wd described above. As the drive electrodes Ed, there exist common electrodes Edc disposed on the inner side surfaces facing the ejection channels C1*e*, C2*e*, and individual electrodes (active electrodes) Eda disposed on the inner side surfaces facing the dummy channels C1*d*, C2*d*. It should be noted that such drive electrodes Ed (the common electrodes Edc and the active electrodes Eda) are each formed in the entire area in the depth direction (the Z-axis direction) on the inner side surface of the drive wall Wd as shown in FIG. 3.

The pair of common electrodes Edc opposed to each other in the same ejection channel C1*e* (or the same ejection channel C2*e*) are electrically connected to each other in a common terminal (a common interconnection Wdc described later). Further, the pair of individual electrodes Eda opposed to each other in the same dummy channel C1*d* (or the same dummy channel C2*d*) are electrically separated from each other. In contrast, the pair of individual electrodes Eda opposed to each other via the ejection channel C1*e* (or the ejection channel C2*e*) are electrically connected to each other in an individual terminal (an individual interconnection Wda described later) not shown, and each of the individual interconnections Wda is arranged to be laid around toward the tail part 420 described above (an interconnection connecting section 43 described later).

Here, in the tail parts 420, there are mounted the flexible printed circuit boards 441, 442 described above for electrically connecting the drive electrodes Ed and the circuit board described above to each other. Although the details will be described later (see FIG. 5 through FIG. 9), the interconnection patterns formed in these flexible printed circuit boards 441, 442 are electrically connected to the common interconnection Wdc and the individual interconnections Wda described above in the interconnection connecting section 43 described later. Thus, it is arranged that the drive voltage is applied to each of the drive electrodes Ed from the drive circuit on the circuit board described above via these flexible printed circuit boards 441, 442.

(Cover Plate 413)

As shown in FIG. 3, FIG. 5 and FIG. 6, the cover plate 413 is disposed so as to close the channels C1, C2 (the channel columns 421, 422) in the actuator plate 412. Specifically, the cover plate 413 is bonded to the upper surface of the actuator plate 412, and has a plate-like structure.

As shown in FIG. 4 through FIG. 6, the cover plate 413 is provided with a pair of entrance side common ink chambers Rin1, Rin2 and a pair of exit side common ink chambers Rout1, Rout2. The entrance side common ink chambers Rin1, Rin2 and the exit side common ink chambers Rout1, Rout2 each extend along the X-axis direction, and are arranged side by side so as to be parallel to each other at predetermined intervals. Further, the entrance side common ink chamber Rin1 and the exit side common ink chamber Rout1 are each formed in an area corresponding to the channel column 421 (the plurality of channels C1) in the actuator plate 412. Meanwhile, the entrance side common ink chamber Rin2 and the exit side common ink chamber Rout2 are each formed in an area corresponding to the channel column 422 (the plurality of channels C2) in the actuator plate 412.

The entrance side common ink chamber Rin1 is formed in the vicinity of an inner end part along the Y-axis direction in the channels C1, and forms a groove section having a recessed shape (see FIG. 4 through FIG. 6). In areas corresponding respectively to the ejection channels C1*e* in the entrance side common ink chamber Rin1, there are respectively formed supply slits Sin1 penetrating the cover plate 413 along the thickness direction (the Z-axis direction) of the cover plate 413 (see FIG. 4 and FIG. 5). Similarly, the entrance side common ink chamber Rin2 is formed in the vicinity of an inner end part along the Y-axis direction in the channels C2, and forms a groove section having a recessed shape (see FIG. 4 through FIG. 6). In areas corresponding respectively to the ejection channels C2*e* in the entrance side common ink chamber Rin2, there are respectively formed supply slits Sin2 penetrating the cover plate 413 along the thickness direction of the cover plate 413 (see FIG. 4 and FIG. 5).

The exit side common ink chamber Rout1 is formed in the vicinity of an outer end part along the Y-axis direction in the channels C1, and forms a groove section having a recessed shape (see FIG. 4 through FIG. 6). In areas corresponding respectively to the ejection channels C1*e* in the exit side common ink chamber Rout1, there are respectively formed discharge slits Sout1 penetrating the cover plate 413 along the thickness direction of the cover plate 413 (see FIG. 4 and FIG. 5). Similarly, the exit side common ink chamber Rout2 is formed in the vicinity of an outer end part along the Y-axis direction in the channels C2, and forms a groove section having a recessed shape (see FIG. 4 through FIG. 6). In areas corresponding respectively to the ejection channels C2*e* in the exit side common ink chamber Rout2, there are respectively formed discharge slits Sout2 penetrating the cover plate 413 along the thickness direction of the cover plate 413 (see FIG. 4 and FIG. 5).

Here, the supply slits Sin1 and the discharge slits Sout1 are each a through hole through which the ink 9 flows to or from the ejection channel C1*e*, and the supply slits Sin2 and the discharge slits Sout2 are each a through hole through which the ink 9 flows to or from the ejection channel C2*e*. In detail, as indicated by the dotted arrows in FIG. 5, the supply slits Sin1, Sin2 are through holes for making the ink 9 inflow into the ejection channels C1*e*, C2*e*, respectively. In contrast, the discharge slits Sout1, Sout2 are through holes for making the ink 9 outflow from the ejection channels C1*e*, C2*e*, respectively.

Further, as shown in FIG. 4 through FIG. 6, the cover plate 413 is provided with wall parts W1, W2. The wall part W1 is disposed between the entrance side common ink chamber Rin1 and the exit side common ink chamber Rout1 so as to cover above the ejection channels C1*e*. Similarly, the wall part W2 is disposed between the entrance side common ink chamber Rin2 and the exit side common ink chamber Rout2 so as to cover above the ejection channels C2*e*.

In such a manner, the entrance side common ink chamber Rin1 and the exit side common ink chamber Rout1 are communicated with each of the ejection channels C1*e* via the supply slit Sin1 and the discharge slit Sout1 on the one hand, but are not communicated with each of the dummy channels C1*d* on the other hand (see FIG. 5 and FIG. 6). In other words, it is arranged that each of the dummy channels C1*d* is closed by a bottom part of the entrance side common ink chamber Rin1 and a bottom part of the exit side common ink chamber Rout1 (see FIG. 6).

Similarly, the entrance side common ink chamber Rin2 and the exit side common ink chamber Rout2 are communicated with each of the ejection channels C2*e* via the supply slit Sin2 and the discharge slit Sout2 on the one hand, but are not communicated with each of the dummy channels C2*d* on the other hand (see FIG. 5 and FIG. 6). In other words, it is arranged that each of the dummy channels C2*d* is closed by a bottom part of the entrance side common ink chamber Rin2 and a bottom part of the exit side common ink chamber Rout2 (see FIG. 6).

(Flow Channel Plate 40)

As shown in FIG. 3, the flow channel plate 40 is disposed on the upper surface of the cover plate 413, and has a predetermined flow channel (not shown) through which the ink 9 flows. Further, to the flow channel in such a flow channel plate 40, there are connected the flow channels 50*a*, 50*b* in the circulation mechanism 5 described above so as to achieve inflow of the ink 9 to the flow channel and outflow of the ink 9 from the flow channel, respectively.

[Configuration of Interconnection Connecting Sections]

Then, a configuration of the interconnection connecting sections 43 (an interconnection connecting pattern structure) for electrically connecting the individual interconnections Wda and the common interconnections Wdc to the flexible printed circuit boards 441, 442 described above and so on will be described in detail with reference to FIG. 7 through FIG. 11 in addition to FIG. 4 through FIG. 6.

Figure 7:
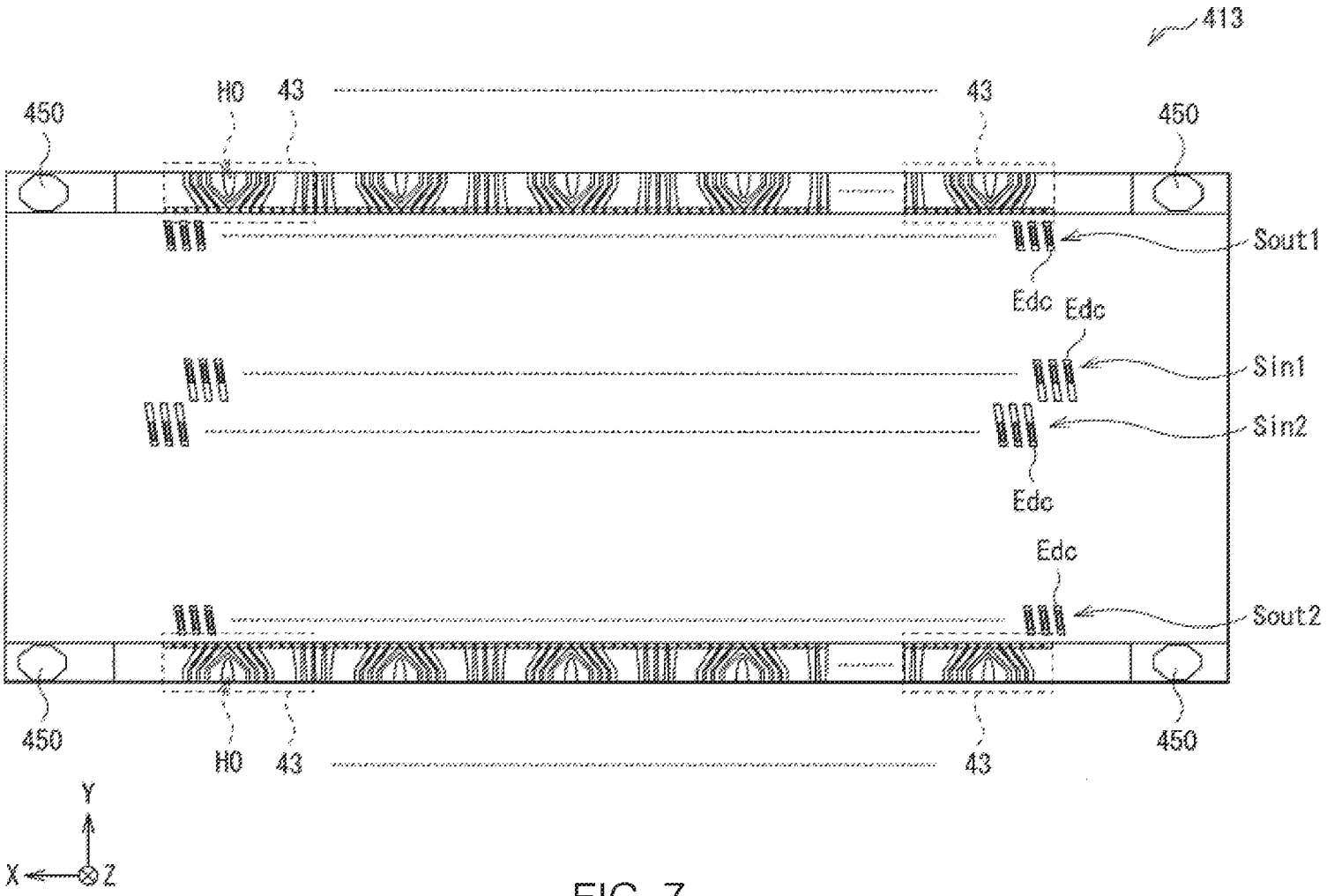
FIG. 7 is a schematic diagram showing a bottom surface configuration example of the cover plate shown in FIG. 4.
Figure 8:
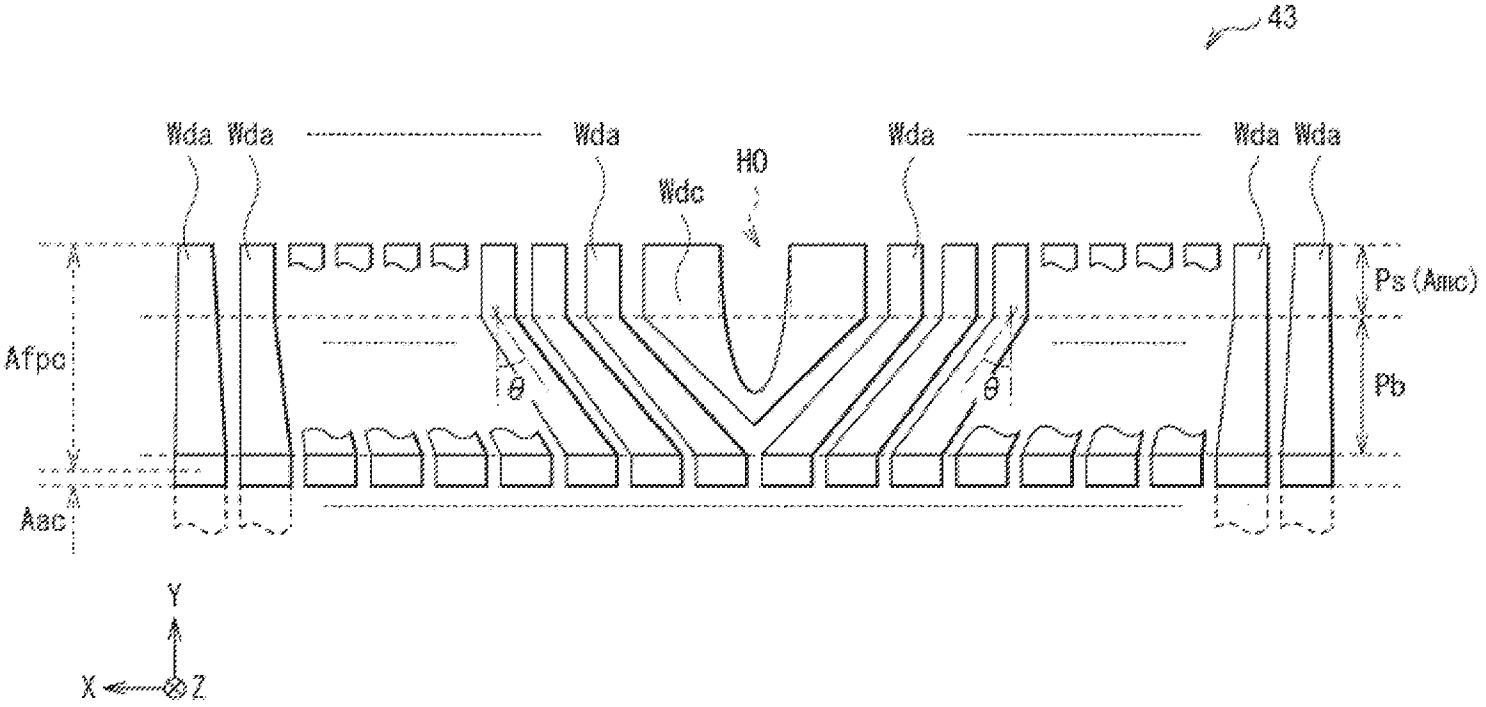
FIG. 8 is a schematic diagram showing a planar configuration example of the interconnection connecting sections shown in FIG. 7.
Figure 9:
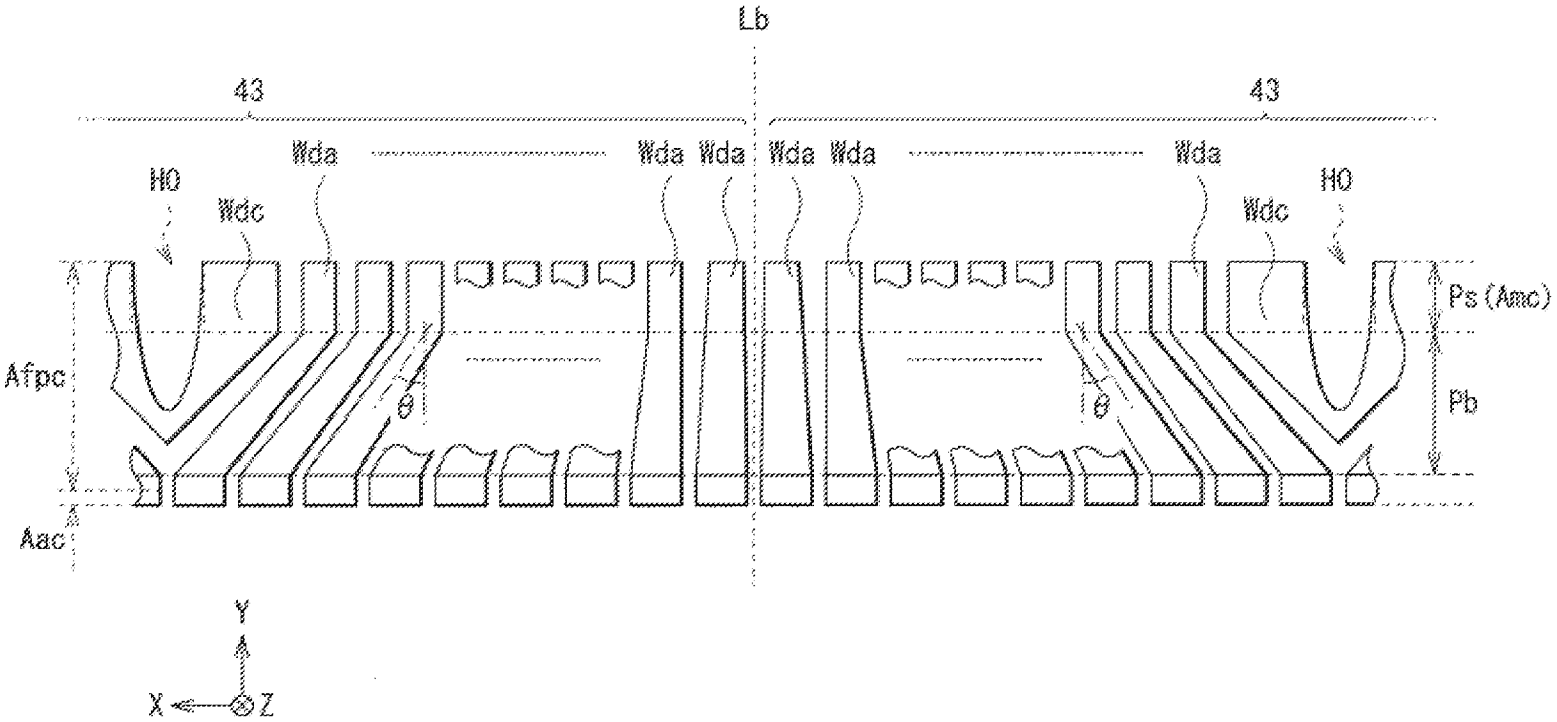
FIG. 9 is a schematic diagram showing a planar configuration example of the vicinity of a boundary between the interconnection connecting sections shown in FIG. 7.
Figure 10:
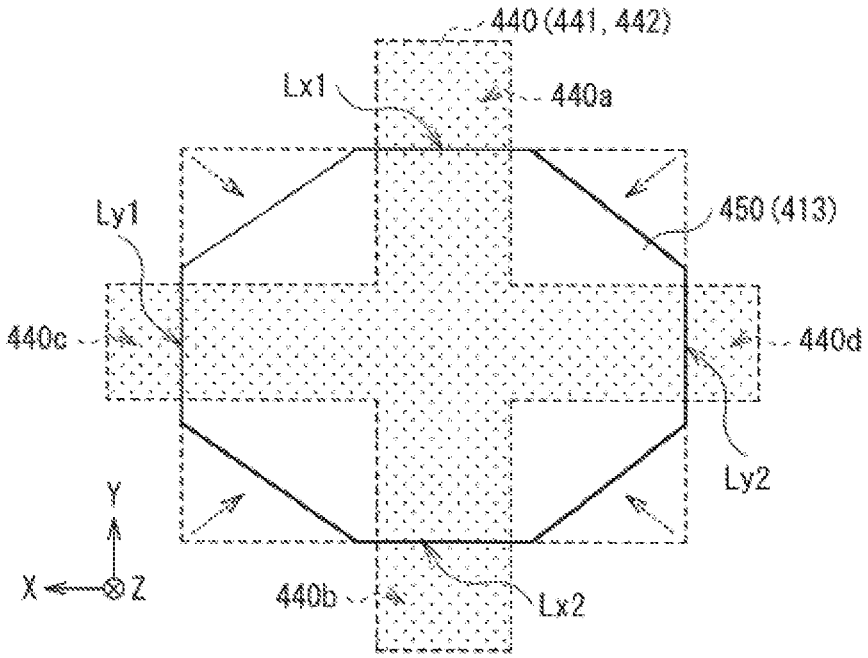
FIG. 10 is a schematic diagram showing a planar configuration example of an alignment mark according to the embodiment.
Figure 11:
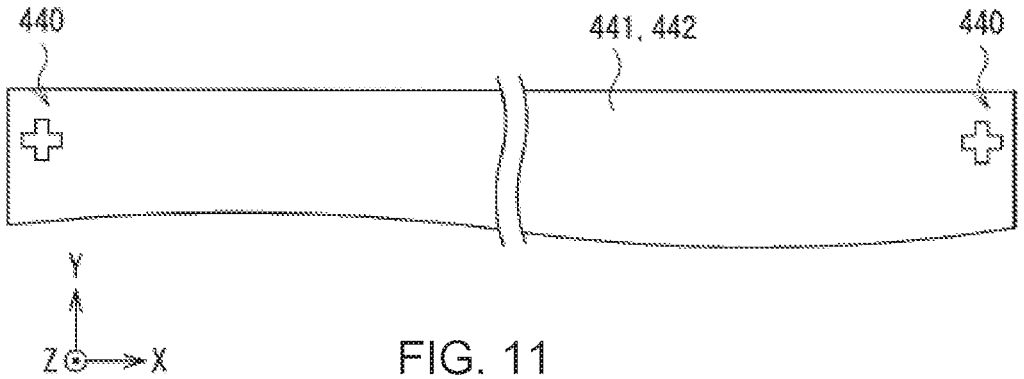
FIG. 11 is a schematic diagram showing a planar configuration example of the alignment marks on the flexible printed circuit board shown in FIG. 10.

Here, FIG. 7 is a diagram schematically showing a bottom surface configuration example (an X-Y bottom surface configuration example) of a cover plate 413 shown in FIG. 4. FIG. 8 is a diagram schematically showing a planar configuration example (an X-Y planar configuration example) of the interconnection connecting section 43 shown in FIG. 7. FIG. 9 is a diagram schematically showing a planar configuration example (an X-Y planar configuration example) of the vicinity of a boundary between the interconnection connecting sections 43 shown in FIG. 7. FIG. 10 is a diagram schematically showing a planar configuration example (an X-Y planar configuration example) of alignment marks (an FPC side alignment mark 440 and a CP side alignment mark 450 described later) according to the present embodiment. FIG. 11 is a diagram schematically showing a planar configuration example (an X-Y planar configuration example) of the FPC side alignment marks 440 shown in FIG. 10 on the flexible printed circuit boards 441, 442.

In the head chip 41 according to the present embodiment, firstly, the common electrodes Edc respectively formed in the plurality of ejection channels C1*e* are electrically connected to each other, and are extracted as the common interconnections Wdc described above (see FIG. 4 through FIG. 6). Although the details will be described later, the common interconnections Wdc are electrically connected to extraction electrodes on the flexible printed circuit board 441 described above on the bottom surface of the cover plate 413 (see the reference symbol P11 in FIG. 5). Further, the common interconnections Wdc are extracted from the inside of the exit side common ink chamber Rout1 via cutout parts H0 penetrating the cover plate 413 (see FIG. 4 and FIG. 5). It should be noted that through holes can also be used instead of the cutout parts H0 as parts (for electrically connecting the common interconnections Wdc) through which the common interconnections Wdc penetrate the cover plate 413 in such a manner.

Similarly, in the head chip 41, the common electrodes Edc respectively formed in the plurality of ejection channels C2*e* are electrically connected to each other, and are extracted as the common interconnections Wdc (see FIG. 4 through FIG. 6). Although the details will be described later, the common interconnections Wdc are electrically connected to extraction electrodes on the flexible printed circuit board 442 described above on the bottom surface of the cover plate 413 (see the reference symbol P12 in FIG. 5). Further, the common interconnections Wdc are extracted from the inside of the exit side common ink chamber Rout2 via the cutout parts H0 penetrating the cover plate 413 (see FIG. 4 and FIG. 5). It should be noted that similarly in this part, through holes can also be used instead of the cutout parts H0 as parts through which the common interconnections Wdc penetrate the cover plate 413.

Further, in the head chip 41 of the present embodiment, the individual electrodes Eda respectively formed in the plurality of dummy channels C1*d* are also electrically connected individually in such a manner described below in detail. Specifically, the individual electrodes Eda are electrically connected individually to the individual interconnections Wda, firstly, in such a manner as described above. Further, these individual interconnections Wda are laid around in such a manner as described above to thereby be electrically connected individually to the extraction electrodes on the flexible printed circuit board 441 on the bottom surface of the cover plate 413 (see the reference symbol P11 in FIG. 5). Meanwhile, the individual electrodes Eda respectively formed in the plurality of dummy channels C2*d* are also electrically connected individually to the extraction electrodes on the flexible printed circuit boards 442 on the bottom surface of the cover plate 413 via the individual interconnections Wda described above in substantially the same manner as the individual electrodes Eda in the dummy channels C1*d* described above (see the reference symbol P12 in FIG. 5). It should be noted that when electrically connecting such individual electrodes Eda to the individual interconnections Wda, the pair of drive electrodes Ed disposed on the pair of drive walls Wd forming one ejection channel C1*e* (or one ejection channel C2*e*) are connected to the same individual interconnection Wda as a unit. In other words, as described above, the pair of individual electrodes Ed opposed to each other via one ejection channel C1*e* (or one ejection channel C2*e*) are electrically connected to each other in one individual interconnection Wda. Therefore, it is arranged that such a pair of individual electrodes Eda are commonalized on the actuator plate 412.

Here, on the bottom surface of the cover plate 413 of the present embodiment, there are disposed the interconnection connecting sections 43 for electrically connecting the plurality of individual interconnections Wda and the common interconnections Wdc laid around in such a manner to the flexible printed circuit boards 441, 442 (see FIG. 7 through FIG. 9). Specifically, in the connecting area to the extraction electrodes on the flexible printed circuit boards 441, 442 on the bottom surface of the cover plate 413 described above, there are disposed such interconnection connecting sections 43. In detail, as shown in FIG. 7, on the bottom surface of the cover plate 413, there are disposed the interconnection connecting sections 43 respectively in the both end part areas along the Y-axis direction (the short-side direction) perpendicular to an arrangement direction (the longitudinal direction, the X-axis direction) of the ejection channels C1*e*, C2*e* and the dummy channels C1*d*, C2*d*.

In one of the end part areas along the Y-axis direction, the plurality of interconnection connecting sections 43 for electrically connecting the plurality of individual interconnections Wda and the common interconnections Wdc corresponding to the channels C1 (C1*e*, C1*d*) respectively to the flexible printed circuit board 441 is arranged side by side along the X-axis direction. Further, in the other of the end part areas along the Y-axis direction, the plurality of interconnection connecting sections 43 for electrically connecting the plurality of individual interconnections Wda and the common interconnections Wdc corresponding to the channels C2 (C2*e*, C2*d*) respectively to the flexible printed circuit board 442 is arranged side by side along the X-axis direction.

As shown in FIG. 8 and FIG. 9, in each of such interconnection connecting sections 43, firstly, the cutout parts H0 (or the through holes) described above are disposed around the central part along the X-axis direction. On the inner side surface of the cutout part H0, there is formed the common interconnection Wdc (see FIG. 5). Further, in each of the interconnection connecting sections 43, the plurality of individual interconnections Wda is arranged side by side on each of the both sides of the cutout part H0 (the common interconnection Wdc) along the X-axis direction. It should be noted that in each of the interconnection connecting sections 43, the common interconnection Wdc and the plurality of individual interconnections Wda are arranged at predetermined intervals, and are electrically separated from each other.

Here, as shown in FIG. 8 and FIG. 9, the plurality of individual interconnections Wda in each of the interconnection connecting sections 43 each has the straight part Ps extending along the Y-axis direction (the short-side direction described above). The straight part Ps is a part located on the tip side (an end part side along the short-side direction in the cover plate 413) of each of the individual interconnections Wda, and also functioning as a capacitance measurement area Amc although the detail will be described later. Further, the plurality of individual interconnections Wda in each of the interconnection connecting sections 43 each has the bend part Pb extending in an oblique direction crossing the X-axis direction and the Y-axis direction so as to circumvent the cutout part H0 (the common interconnection Wdc) acting as an obstacle. The bend part Pb is connected to the straight part Ps, and is disposed on the base end side of the straight part Ps.

Further, in each of the interconnection connecting sections 43, the bend angle θ formed by the oblique direction described above in each of the individual interconnections Wda gradually decreases as a distance (a distance along the X-axis direction) from the cutout part H0 (the common interconnection Wdc) located in the vicinity of the central part to each of the individual interconnections Wda increases (see FIG. 8 and FIG. 9). In other words, the bend angle θ in each of the individual interconnections Wda gradually increases as a distance (a distance along the X-axis direction) from a boundary point Lb (see FIG. 9) between the interconnection connecting sections 43 adjacent to each other along the X-axis direction to the cutout part H0 (the common interconnection Wdc) in each of the interconnection connecting sections 43 increases. It should be noted that the bend angle θ is defined here as an angle (acute angle) formed by the oblique direction (the extending direction of each of the individual interconnections Wda) described above with respect to the Y-axis direction (the extending direction of each of the straight parts Ps).

Here, as shown in FIG. 8 and FIG. 9, in each of the interconnection connecting sections 43, the connection area Afp between the plurality of individual interconnections Wda and the flexible printed circuit boards 441, 442 is arranged to be an area including the bend part Pb in each of the individual interconnections Wda. In detail, in each of the interconnection connecting sections 43 of the present embodiment, the connection area Afpc is defined as an area including both of the bend part Pb and the straight part Ps (the capacitance measurement area Amc) in each of the individual interconnections Wda. It should be noted that in FIG. 8 and FIG. 9, the connection area Aac represents the connection area of each of the individual interconnections Wda to the actuator plate 412 side. Further, the extraction electrodes are formed on the flexible printed circuit boards 441, 442 so as to correspond respectively to the common interconnections Wdc and the individual interconnections Wda, and the extraction electrodes are arranged to be connected respectively to the common interconnections Wdc and the individual interconnections Wda.

Further, in the present embodiment, there are disposed alignment marks for achieving the alignment between the plurality of individual interconnections Wda in such a head chip 41 (the interconnection connecting sections 43 on the cover plate 413) and the extraction electrodes on the flexible printed circuit boards 441, 442. Specifically, on the cover plate 413, there are disposed the CP (cover plate) side alignment marks 450 in the end part areas (the areas in the vicinity of the four corners on the bottom surface of the cover plate 413 in this example as shown in FIG. 7) along the X-axis direction. The CP side alignment marks 450 each have a shape (see the dotted arrows in FIG. 10) obtained by chamfering the corners in a rectangular shape, and each have an octagon shape having a longitudinal direction (the X-axis direction) and a short-side direction (the Y-axis direction) as shown in, for example, FIG. 10. In contrast, as shown in, for example, FIG. 10 and FIG. 11, on the flexible printed circuit boards 441, 442 (areas in the vicinity of two corners in this example as shown in FIG. 11), there are disposed FPC side alignment marks 440 each having a cross-like shape.

In the present embodiment, the alignment is performed in such a manner as shown in, for example, FIG. 10 using the CP side alignment marks 450 on such a cover plate 413, and the FPC side alignment marks 440 on the flexible printed circuit boards 441, 442. Specifically, firstly, the alignment is performed by fitting the central part of the cross-like shape in the FPC side alignment mark 440 into the CP side alignment mark 450. Further, at the same time, the alignment is performed by overlapping the cover plate 413 and the flexible printed circuit boards 441, 442 each other so that the sides (sides Lx1, Lx2) parallel to the X-axis direction and the sides (sides Ly1, Ly2) parallel to the Y-axis direction in the CP side alignment mark 450 respectively pass through the four linear parts 440*a*, 440*b*, 440*c*, and 440*d* of the cross-like shape in the FPC side alignment mark 440 in the width directions of the four linear parts 440*a*, 440*b*, 440*c*, and 440*d*.

Here, the X-axis direction corresponds to one specific example of a "first direction" in the present disclosure, and the Y-axis direction corresponds to one specific example of a "second direction (a direction perpendicular to the first direction)" in the present disclosure. Further, the flexible printed circuit boards 441, 442 each correspond to one specific example of a "wiring board" in the present disclosure, and the cutout parts H0 (and the through holes described above) each correspond to one specific example of an "obstacle" in the present disclosure. Further, the CP side alignment marks 450 each correspond to one specific example of a "first alignment mark" in the present disclosure, and the FPC side alignment marks 440 each correspond to one specific example of a "second alignment mark" in the present disclosure.

[Operations and Functions/Advantages]

(A. Basic Operation of Printer 1)

In the printer 1, a recording operation (a printing operation) of images, characters, and so on to the recording paper P is performed in the following manner. It should be noted that as an initial state, it is assumed that the four types of ink tanks 3 (3Y, 3M, 3C, and 3B) shown in FIG. 1 are sufficiently filled with the ink 9 of the corresponding colors (the four colors), respectively. Further, there is achieved the state in which the inkjet heads 4 are filled with the ink 9 in the ink tanks 3 via the circulation mechanism 5, respectively.

In such an initial state, when operating the printer 1, the grit rollers 21 in the carrying mechanisms 2*a*, 2*b* rotate to thereby carry the recording paper P along the carrying direction d (the X-axis direction) between the grit rollers 21 and the pinch rollers 22. Further, at the same time as such a carrying operation, the drive motor 633 in the drive mechanism 63 respectively rotates the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C, and 4B) to thereby perform the recording operation of images, characters, and so on to the recording paper P.

(B. Detailed Operation in Inkjet Heads 4)

Then, the detailed operation (the jet operation of the ink 9) in the inkjet heads 4 will be described with reference to FIG. 1 through FIG. 6. Specifically, in the inkjet heads 4 (the side-shoot type) according to the present embodiment, the jet operation of the ink 9 using a shear mode is performed in the following manner.

Firstly, when the reciprocation of the carriage 62 (see FIG. 1) described above is started, the drive circuit on the circuit board described above applies the drive voltage to the drive electrodes Ed (the common electrodes Edc and the individual electrodes Eda) in the inkjet head 4 (the head chip 41) via the flexible printed circuit boards 441, 442. Specifically, the drive circuit applies the drive voltage to the drive electrodes Ed disposed on the pair of drive walls Wd forming the ejection channel C1*e*, C2*e*. Thus, the pair of drive walls Wd each deform (see FIG. 3) so as to protrude toward the dummy channel C1*d*, C2*d* adjacent to the ejection channel C1*e*, C2*e*.

Here, as described above, in the actuator plate 412, the polarization direction differs along the thickness direction (the two piezoelectric substrates described above are stacked on one another), and at the same time, the drive electrodes Ed are formed in the entire area in the depth direction on the inner side surface in each of the drive walls Wd. Therefore, by applying the drive voltage using the drive circuit described above, it results that the drive wall Wd makes a flexion deformation to have a V shape centered on the intermediate position in the depth direction in the drive wall Wd. Further, due to such a flexion deformation of the drive wall Wd, the ejection channel C1*e*, C2*e* deforms as if the ejection channel C1*e*, C2*e* bulges. Incidentally, in the case in which the configuration of the actuator plate 412 is not the chevron type but is the cantilever type described above, the drive wall Wd makes the flexion deformation to have the V shape in the following manner. That is, in the case of the cantilever type, since it results that the drive electrode Ed is attached by the oblique evaporation to an upper half in the depth direction, by the drive force exerted only on the part provided with the drive electrode Ed, the drive wall Wd makes the flexion deformation (in the end part in the depth direction of the drive electrode Ed). As a result, even in this case, since the drive wall Wd makes the flexion deformation to have the V shape, it results that the ejection channel C1*e*, C2*e* deforms as if the ejection channel C1*e*, C2*e* bulges.

As described above, due to the flexion deformation caused by a piezoelectric thickness-shear effect in the pair of drive walls Wd, the capacity of the ejection channel C1*e*, C2*e* increases. Further, due to the increase of the capacity of the ejection channel C1*e*, C2*e*, it results that the ink 9 retained in the entrance side common ink chamber Rin1, Rin2 is induced into the ejection channel C1*e*, C2*e* (see FIG. 5).

Subsequently, the ink 9 having been induced into the ejection channel C1*e*, C2*e* in such a manner turns to a pressure wave to propagate to the inside of the ejection channel C1*e*, C2*e*. Then, the drive voltage to be applied to the drive electrodes Ed becomes 0 (zero) V at the timing at which the pressure wave has reached the nozzle hole H1, H2 of the nozzle plate 411. Thus, the drive walls Wd are restored from the state of the flexion deformation described above, and as a result, the capacity of the ejection channel C1*e*, C2*e* having once increased is restored again (see FIG. 3).

When the capacity of the ejection channel C1*e*, C2*e* is restored in such a manner, the internal pressure of the ejection channel C1*e*, C2*e* increases, and the ink 9 in the ejection channel C1*e*, C2*e* is pressurized. As a result, the ink 9 having a droplet shape is ejected (see FIG. 3 and FIG. 5) toward the outside (toward the recording paper P) through the nozzle hole H1, H2. The jet operation (the ejection operation) of the ink 9 in the inkjet head 4 is performed in such a manner, and as a result, the recording operation of images, characters, and so on to the recording paper P is performed.

In particular, the nozzle holes H1, H2 of the present embodiment each have the tapered cross-sectional shape gradually decreasing in diameter toward the outlet (see FIG. 3 and FIG. 5) as described above, and can therefore eject the ink 9 straight (good in straightness) at high speed. Therefore, it becomes possible to perform recording high in image quality.

(C. Circulation Operation of Ink 9)

Then, the circulation operation of the ink 9 by the circulation mechanism 5 will be described in detail with reference to FIG. 1 and FIG. 5.

As shown in FIG. 1, in the printer 1, the ink 9 is fed by the liquid feeding pump 52*a* from the inside of the ink tank 3 to the inside of the flow channel 50*a*. Further, the ink 9 flowing through the flow channel 50*b* is fed by the liquid feeding pump 52*b* to the inside of the ink tanks 3.

On this occasion, in the inkjet head 4, the ink 9 flowing from the inside of the ink tank 3 via the flow channel 50*a* passes through the flow channel of the flow channel plate 40 to inflow into the entrance side common ink chamber Rin1, Rin2 (see FIG. 2). The ink 9 having been supplied to these entrance side common ink chambers Rin1, Rin2 is supplied to the ejection channels C1*e*, C2*e* in the actuator plate 412 via the supply slits Sin1, Sin2 (see FIG. 5).

Further, the ink 9 in the ejection channels C1*e*, C2*e* flows into the exit side common ink chamber Rout1, Rout2 via the discharge slits Sout1, Sout2 (see FIG. 5). The ink 9 having been supplied to these exit side common ink chambers Rout1, Rout2 are discharged to the flow channel 50*b* via the flow channel of the flow channel plate 40 to thereby outflow from the inkjet head 4 (see FIG. 2). Then, the ink 9 having been discharged to the flow channel 50*b* is returned to the inside of the ink tank 3 as a result. In such a manner, the circulation operation of the ink 9 by the circulation mechanism 5 is achieved.

Here, in the inkjet head which is not the circulation type, in the case in which ink of a fast drying type is used, there is a possibility that a local increase in viscosity or local solidification of the ink occurs due to drying of the ink in the vicinity of the nozzle hole, and as a result, a failure such as a failure in ejection of the ink occurs. In contrast, in the inkjet heads 4 (the circulation type inkjet heads) according to the present embodiment, since the fresh ink 9 is always supplied to the vicinity of the nozzle holes H1, H2, the failure such as the failure in ejection of the ink described above is prevented as a result.

(D. Functions/Advantages)

Then, the functions and the advantages in the head chip 41, the inkjet head 4 and the printer 1 according to the present embodiment will be described in detail while comparing with comparative examples (Comparative Example 1 and Comparative Example 2).

(Comparative Example 1)

Figure 12:
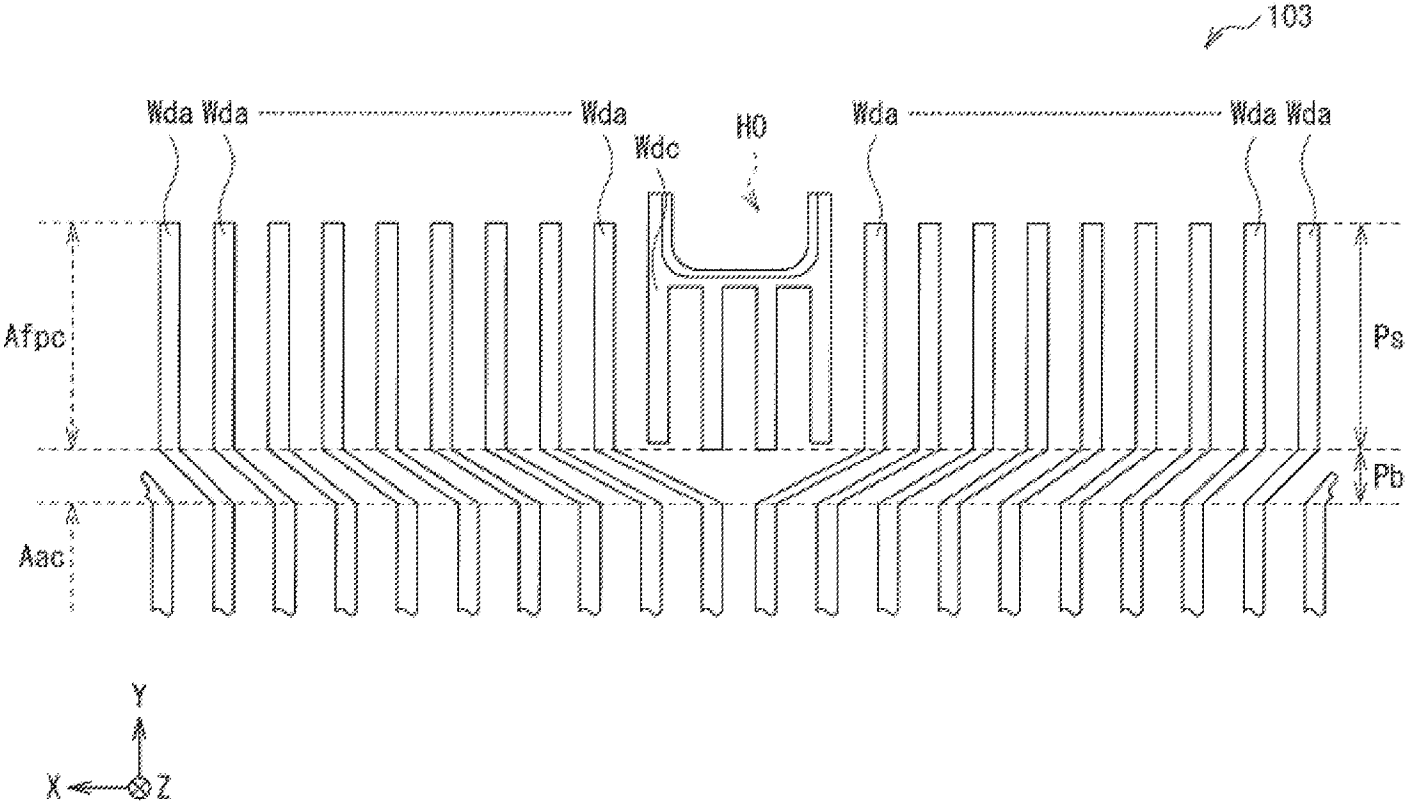
FIG. 12 is a schematic diagram showing a planar configuration example of interconnection connecting sections related to Comparative Example 1.

FIG. 12 is a diagram schematically showing a planar configuration example (an X-Y planar configuration example) of an interconnection connecting section (interconnection connecting section 103) provided to a cover plate in a head chip related to Comparative Example 1. The interconnection connecting section 103 of the Comparative Example 1 corresponds to what is made to differ in the configuration of the connection area Afpc described above in the interconnection connecting section 43 according to the present embodiment shown in FIG. 8 and FIG. 9. Specifically, as described above in the interconnection connecting section 43, the connection area Afpc includes the bend part Pb of each of the individual interconnections Wda on the one hand, but in the interconnection connecting section 103, the connection area Afpc is constituted only by the straight part Ps of each of the individual interconnections Wda as shown in FIG. 12.

In the interconnection connecting section 103 of such Comparative Example 1, since the area of each of the individual interconnections Wda in the connection area Afpc becomes small to increase the connection resistance in each of the individual interconnections Wda, the reliability degrades in the head chip of Comparative Example 1 as a result. Further, in the case of attempting to decrease the connection resistance, since it is necessary to increase the length of the straight part Ps in order to increase the area of each of the individual interconnections Wda, and in that case, the length in the Y-axis direction of the connection area Afpc also increases. As a result, in Comparative Example 1, growth in size (an increase in length in the short-side direction of the head chip) of the chip size is incurred. According to the above facts, it can be said that it is difficult for the head chip of Comparative Example 1 to achieve miniaturization while improving the reliability.

(Present Embodiment)

In contrast, in the head chip 41 according to the present embodiment, as shown in FIG. 8 and FIG. 9, the bend part Pb of each of the individual interconnections Wda is included in the connection area Afpc between the plurality of individual interconnections Wda and the flexible printed circuit boards 441, 442 in the interconnection connecting section 43 of the cover plate 413.

Thus, in the present embodiment, the following is achieved compared to the case (e.g., Comparative Example 1 described above) in which, for example, such a connection area Afpc is constituted only by the straight part Ps of each of the individual interconnections Wda. Specifically, firstly, the bend part Pb of each of the individual interconnections Wda extends in the oblique direction described above so as to circumvent the cutout part H0 (the common interconnection Wdc) acting as an obstacle (see FIG. 8 and FIG. 9). Therefore, in the interconnection connecting section 43 of the present embodiment, the area of each of the individual interconnections Wda in the inside of the connection area Afpc increases compared to the case of the interconnection connecting section 103 of Comparative Example 1 described above, and the connection resistance in each of the individual interconnections Wda decreases. Further, since the connection resistance in each of the individual interconnections Wda decreases in such a manner, it is not required to increase the length in the Y-axis direction of the connection area Afpc in order to reduce the connection resistance unlike the case of Comparative Example 1 described above. Therefore, it becomes sufficient for the length in the Y-axis direction of the connection area Afpc to be short. According to the above facts, in the present embodiment, it becomes possible to achieve the miniaturization of the chip size (to shorten the length in the short-side direction (the Y-axis direction) of the head chip 41) while improving the reliability of the head chip 41 compared to Comparative Example 1.

Further, in particular in the present embodiment, the connection area Afpc in the interconnection connecting section 43 of the cover plate 413 is made as an area including both of the bend part Pb and the straight part Ps (the capacitance measurement area Amc) in each of the individual interconnections Wda as shown in FIG. 8 and FIG. 9. Since the straight part Ps is also included in the connection area Afpc in addition to the bend part Pb in such a manner as described above, by, for example, using the straight part Ps as the capacitance measurement area Amc, such a measurement operation of the capacitance as described below becomes easy. Specifically, the measurement operation of the capacitance is generally performed in a state in which one of two probes is applied to one individual interconnection Wda, and at the same time the other of the probes is applied to the common interconnection Wdc. Therefore, in the case of, for example, using the bend part Pb also as the capacitance measurement area Amc, alignment of the touch positions of the probes to the individual interconnection Wda and the common interconnection Wdc becomes difficult. This is because the distance between the two probes becomes different by the depth direction (the Y-axis direction) of the bend part Pb. In contrast, in the present embodiment, since the straight part Ps is used as the capacitance measurement area Amc, and the straight parts Ps are disposed in parallel to each other, the distance (the distance between the individual interconnection Wda to be the target and the common interconnection Wdc) between the two probes does not change with the Y-axis direction. In such a manner as described above, since the measurement operation of the capacitance between the plurality of individual interconnections Wda and the common interconnection Wdc becomes easy in the present embodiment, it is possible to easily perform checking of broken lines and short circuit in the individual electrodes Eda, the individual interconnections Wda, the common electrodes Edc, and the common interconnections Wdc, pre-grasping of the ejection speed of the ink 9 from the head chip 41, and so on. Therefore, in the present embodiment, it becomes possible to improve the convenience.

Further, in the present embodiment, in each of the interconnection connecting sections 43, the bend angle θ described above in each of the individual interconnections Wda gradually decreases as a distance from the cutout part H0 (the common interconnection Wdc) to each of the individual interconnections Wda increases (see FIG. 8 and FIG. 9). Thus, since the area efficiency when arranging the plurality of individual interconnections Wda in the connection area Afpc becomes the highest, the connection resistance in the connection area Afpc is further reduced. Further, since the change in the connection area between the individual interconnections Wda adjacent to each other gradually increases or decreases along the X-axis direction, the variation of the connection resistance between the individual interconnections Wda is also reduced. Therefore, in the present embodiment, it becomes possible to further enhance the reliability of the head chip 41.

In addition, in the present embodiment, the obstacle as the target circumvented by each of the bend parts Pb in each of the interconnection connecting sections 43 is the cutout part H0 (or the through hole) for inserting the common interconnection Wdc in each of the interconnection connecting sections 43. Thus, it becomes easy to lay the common interconnection Wdc in each of the interconnection connecting sections 43, and at the same time, since the area of the common interconnections Wdc increases by disposing the common interconnections Wdc around such a cutout part H0, the interconnection resistance of the common interconnection Wdc is reduced. Therefore, in the present embodiment, it becomes possible to achieve (to further shorten the length in the short-side direction of the head chip 41) further miniaturization of the chip size, and at the same time, further enhance the reliability of the head chip 41.

Further, in the present embodiment, there are disposed the FPC side alignment marks 440 and the CP side alignment marks 450 for achieving the alignment between the plurality of individual interconnections Wda in the interconnection connecting section 43 and the extraction electrodes on the flexible printed circuit boards 441, 442. Specifically, the CP side alignment marks 450 each having the shape obtained by chamfering the corner parts in the rectangular shape are disposed on the cover plate 413, and the FPC side alignment marks 440 each having the cross-like shape are disposed on the flexible printed circuit boards 441, 442 (see FIG. 10 and FIG. 11). By performing the alignment between the plurality of individual interconnections Wda in the interconnection connecting section 43 and the extraction electrodes on the flexible printed circuit boards 441, 442 using the FPC side alignment marks 440 and the CP side alignment marks 450 having such shapes in combination with each other, the following can be said in the present embodiment compared to Comparative Example 2 described below.

Figure 13:
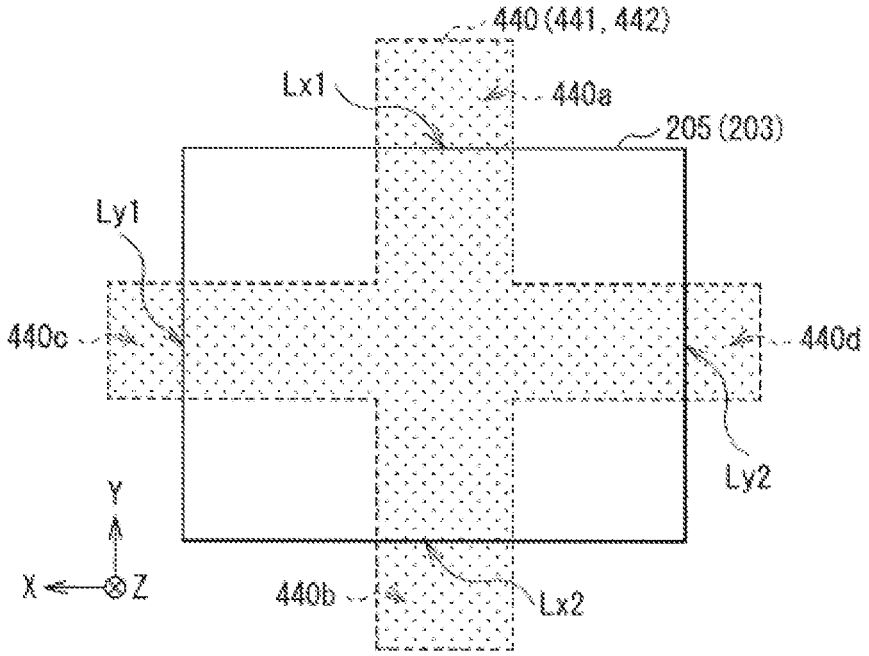
FIG. 13 is a schematic diagram showing a planar configuration example of an alignment mark related to Comparative Example 2.

FIG. 13 is a diagram schematically showing a planar configuration example (an X-Y planar configuration example) of a CP side alignment mark 205 according to Comparative Example 2 together with the FPC side alignment mark 440 of the present embodiment. It should be noted that the CP side alignment mark 205 of Comparative Example 2 is disposed on a cover plate 203 according to Comparative Example 2, and has a rectangular shape (the corner parts are not chamfered unlike the CP side alignment mark 450 of the present embodiment described above).

In the case of performing the alignment described above using the CP side alignment mark 450 of the present embodiment described above, the following is achieved compared to the case of performing the alignment described above using the CP side alignment mark 205 of the Comparative Example 2. Specifically, compared to the CP side alignment mark 205 of Comparative Example 2, in the CP side alignment mark 450 of the present embodiment, the lengths of the sides Lx1, Lx2 in the X-axis direction and the sides Ly1, Ly2 in the Y-axis direction described above are shortened (see FIG. 10 and FIG. 13). Therefore, by performing the alignment in the method described above, it becomes easy to prevent the oblique shift (the position shift in the oblique direction crossing the X-axis direction and the Y-axis direction) in performing the alignment, and at the same time, the alignment operation in the cross directions (rightward and leftward directions and upward and downward directions; the X-axis directions and the Y-axis directions) becomes easy. Therefore, in the present embodiment, it becomes possible to achieve further improvement of the reliability of the head chip 41, and at the same time, it becomes possible to make it easy to assemble the inkjet head 4.

Further, in particular in the present embodiment, such a CP side alignment mark 450 has the octagonal shape having the longitudinal direction (the X-axis direction) and the short-side direction (the Y-axis direction). Thus, in the present embodiment, since it becomes possible to set the direction (the X-axis direction in this example) having the bonding margin to the longitudinal direction, it becomes easier to prevent the oblique shift when performing the alignment described above. As a result, in the present embodiment, it becomes possible to further enhance the reliability of the head chip 41.

Figure 14:
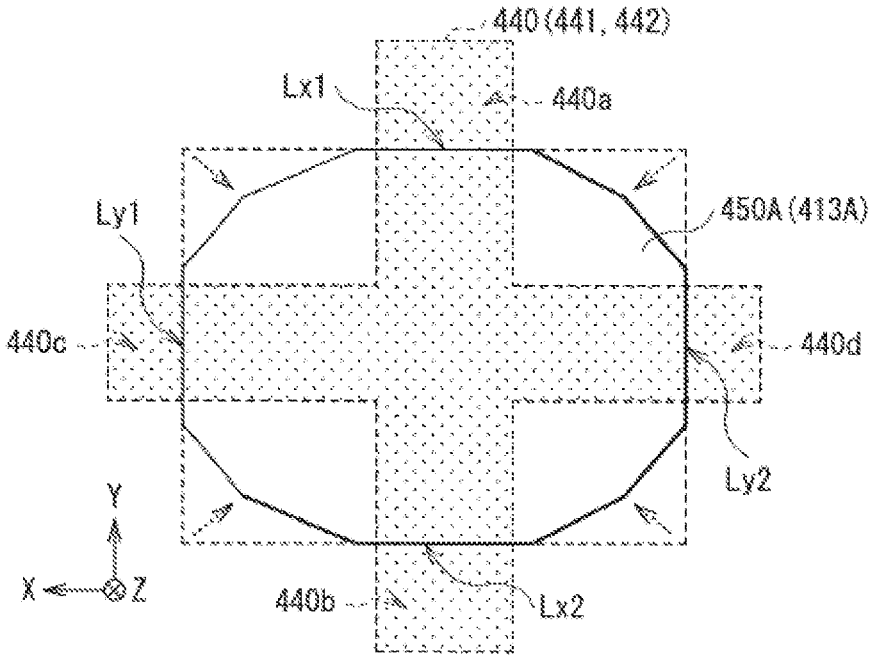
FIG. 14 is a schematic diagram showing a planar configuration example of another alignment mark according to the embodiment.

It should be noted that FIG. 14 is a diagram schematically showing a planar configuration example (an X-Y planar configuration example) of another alignment mark (CP side alignment mark 450A) according to the present embodiment together with the FPC side alignment mark 440 of the present embodiment described above. It should be noted that the CP side alignment mark 450A is disposed on another cover plate (a cover plate 413A) of the present embodiment, and has a dodecagonal shape having the longitudinal direction (the X-axis direction) and the short-side direction (the Y-axis direction). As described above, the shape of the alignment mark disposed on the cover plate 413 is not limited to the octagonal shape (FIG. 10) or the dodecagonal shape (FIG. 14) providing the shape obtained by chamfering the corner part of the rectangular shape, and can also be other shapes.

2. Modified Examples

Then, some modified examples of the embodiment described above will be described. It should be noted that the same constituents as those in the embodiment are denoted by the same reference symbols, and the description thereof will arbitrarily be omitted.

Figure 15:
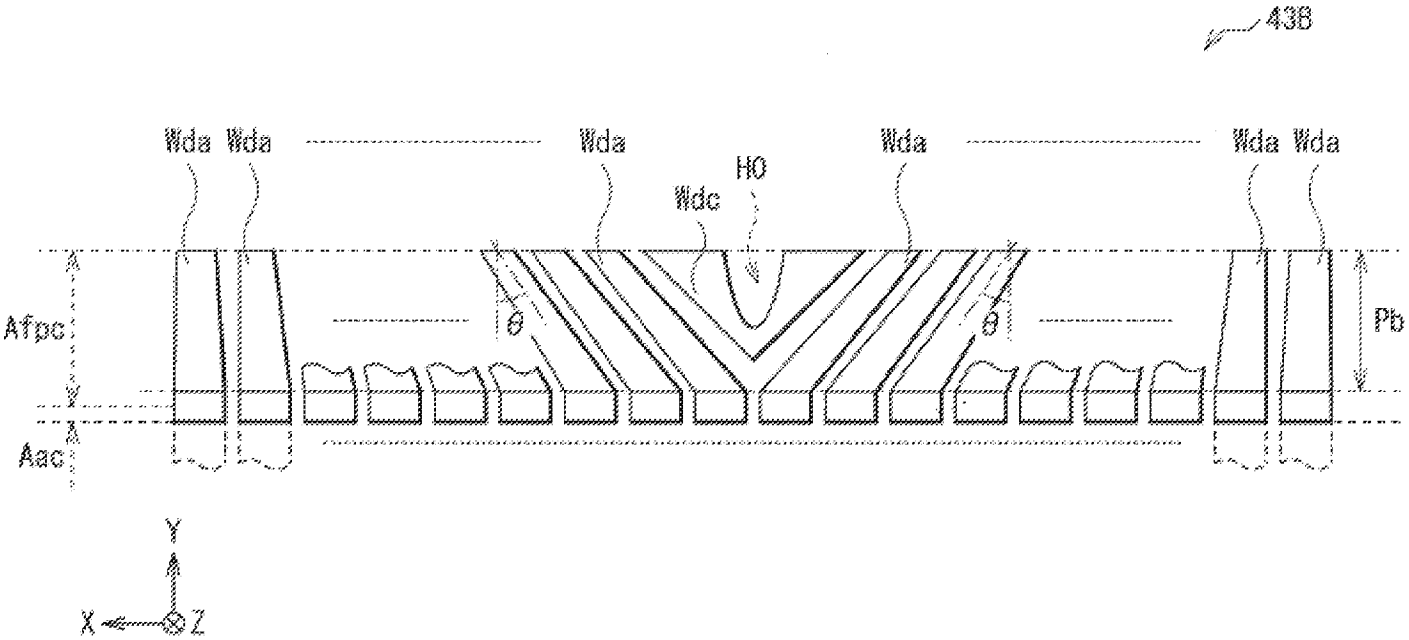
FIG. 15 is a schematic diagram showing a planar configuration example of interconnection connecting sections related to a modified example.

FIG. 15 is a diagram schematically showing a planar configuration example (an X-Y planar configuration example) of an interconnection connecting section (interconnection connecting section 43B) provided to a cover plate in a head chip related to the modified example. The interconnection connecting section 43B of the present modified example corresponds to what is made to differ in the configuration of the connection area Afpc described above in the interconnection connecting section 43 according to the present embodiment shown in FIG. 8 and FIG. 9, and the rest of the configuration is made basically the same.

Specifically, in the interconnection connecting section 43 of the embodiment, both of the bend part Pb and the straight part Ps of each of the individual interconnections Wda are included in the connection area Afpc. In contrast, in the interconnection connecting section 43B of the present modified example, only the bend part Pb of each of the individual interconnections Wda is included in the connection area Afpc. Specifically, each of the individual interconnections Wda in the interconnection connecting section 43B does not have the straight part Ps, but only has the bend part Pb, and it is arranged that the bend part Pb constitutes the connection area Afpc.

In the head chip of the present modified example provided with the interconnection connecting section 43B having such a configuration, it is also possible to obtain basically the same advantage due to the same function as that of the head chip 41 of the embodiment. It should be noted that it can be said that it is more desirable for the connection area Afpc to additionally include the straight part Ps as in the embodiment described above taking the point of the capacitance measurement operation described above into consideration.

It should be noted that unlike the inside of the interconnection connecting section 43B of the present modified example, the following configuration can also be adopted. That is, in the case in which, for example, each of the individual interconnections Wda in the interconnection connecting section has both of the straight part Pa and the bend part Pb, it is possible to arrange that the bend part Pb alone constitutes the connection area Afpc (the straight part Ps does not constitute the connection area Afpc).

3. Other Modified Examples

The present disclosure is described hereinabove citing the embodiment and some modified examples, but the present disclosure is not limited to the embodiment and so on, and a variety of modifications can be adopted.

For example, in the embodiment described above, the description is presented specifically citing the configuration examples (the shapes, the arrangements, the number and so on) of each of the members in the printer, the inkjet head and the head chip, but those described in the above embodiment and so on are not limitations, and it is possible to adopt other shapes, arrangements, numbers and so on. Further, the values or the ranges, the magnitude relation and so on of a variety of parameters described in the above embodiment and so on are not limited to those described in the above embodiment and so on, but can also be other values or ranges, other magnitude relation and so on.

Specifically, for example, in the embodiment described above, the description is presented citing the inkjet head 4 of the two column type (having the two nozzle columns An1, An2), but the example is not a limitation. Specifically, for example, it is also possible to adopt an inkjet head of a single column type (having a single nozzle column), or an inkjet head of a multi-column type (having three or more nozzle columns) with three or more columns (e.g., three columns or four columns).

Further, for example, in the embodiment described above and so on, there is described the case in which the ejection channels (the ejection grooves) and the dummy channels (the non-ejection grooves) each extend along the oblique direction in the actuator plate 412, but this example is not a limitation. Specifically, it is also possible to arrange that, for example, the ejection channels and the dummy channels extend along the Y-axis direction in the actuator plate 412.

Further, for example, the cross-sectional shape of each of the nozzle holes H1, H2 is not limited to the circular shape as described in the above embodiment and so on, but can also be, for example, an elliptical shape, a polygonal shape such as a triangular shape, or a star shape.

Further, for example, the "obstacle" in the present disclosure is not limited to the cutout part H0 or the through hole described in the embodiment and so on described above, and can also be another substance. Specifically, for example, a cutout, a hole and an electric component used for other purposes than the purpose explained in the embodiment and so on described above, or an electrode or an interconnection used other purposes than that of the individual interconnections Wda and the common interconnections Wdc, and a mark for a variety of purposes including the alignment can also be the "obstacle" of the present disclosure.

In addition, in the embodiment and so on described above, the example of the so-called side-shoot type inkjet head fir ejecting the ink 9 from the central part in the extending direction (the oblique direction described above) of the ejection channels C1*e*, C2*e* is described, but the example is not a limitation. Specifically, it is also possible to apply the present disclosure to a so-called edge-shoot type inkjet head for ejecting the ink 9 along the extending direction of the ejection channels C1*e*, C2*e*.

Further, in the embodiment described above, the description is presented citing the circulation type inkjet head for using the ink 9 while circulating the ink 9 mainly between the ink tank and the inkjet head as an example, but the example is not a limitation. Specifically, it is also possible to apply the present disclosure to a non-circulation type inkjet head using the ink 9 without circulating the ink 9.

Further, the series of processes described in the above embodiment and so on can be arranged to be performed by hardware (a circuit), or can also be arranged to be performed by software (a program). In the case of arranging that the series of processes is performed by the software, the software is constituted by a program group for making the computer perform the function. The programs can be incorporated in advance in the computer described above, and are then used, or can also be installed in the computer described above from a network or a recording medium and are then used.

In addition, in the above embodiment, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "head chip" and the "liquid jet head" (the inkjet heads) of the present disclosure are applied to other devices than the inkjet printer. Specifically, for example, it is also possible to arrange that the "head chip" and the "liquid jet head" of the present disclosure are applied to a device such as a facsimile or an on-demand printer.

In addition, it is also possible to apply the variety of examples described hereinabove in arbitrary combination.

It should be noted that the advantages described in the specification are illustrative only but are not a limitation, and another advantage can also be provided.

Further, the present disclosure can also take the following configurations.

<1>

A head chip adapted to jet liquid comprising an actuator plate having a plurality of ejection grooves arranged side by side in a first direction, a plurality of non-ejection grooves arranged side by side along the first direction, and individual electrodes respectively formed in the plurality of non-ejection grooves; a nozzle plate having a plurality of nozzle holes individually communicated with the plurality of ejection grooves; and a cover plate adapted to cover the actuator plate, wherein the cover plate has interconnection connecting sections respectively disposed in end part areas along a second direction perpendicular to the first direction, and adapted to electrically connect a plurality of individual interconnections electrically connected to the individual electrodes to an interconnection board outside the head chip, the plurality of individual interconnections in the interconnection connecting section has a bend part extending in an oblique direction crossing the second direction so as to circumvent a predetermined obstacle, and a connection area between the plurality of individual interconnections and the interconnection board in the interconnection connecting section is an area including the bend part.

<2>

The head chip according to <1>, wherein the plurality of individual interconnections in the interconnection connecting section further includes a straight part extending along the second direction, and the connection area in the interconnection connecting section is an area including both of the bend part and the straight part.

<3>

The head chip according to <1> or <2>, wherein the plurality of individual interconnections is disposed on both sides of the obstacle along the first direction in the interconnection connecting section, and a bend angle as an acute angle formed by the oblique direction with respect to the second direction gradually decreases as a distance along the first direction from the obstacle to the individual interconnection increases in the interconnection connecting section.

<4>

The head chip according to any one of <1> to <3>, wherein as alignment marks for performing alignment between the plurality of individual interconnections and the interconnection board, there are disposed a first alignment mark disposed in an end part area along the first direction in the cover plate, and having a shape obtained by chamfering a corner part in a rectangular shape, and a second alignment mark disposed on the interconnection board, and having a cross-like shape.

<5>

The head chip according to <4>, wherein the first alignment mark has an octagonal shape having a longitudinal direction.

<6>

The head chip according to any one of <1> to <5>, wherein common electrodes are respectively formed in the plurality of ejection grooves, a common interconnection is electrically connected to the common electrodes, and the obstacle is one of a through hole and a cutout part adapted to electrically connect the common interconnection in the interconnection connecting section.

<7>

A liquid jet head comprising the head chip according to any one of <1> to <6>.

<8>

A liquid jet recording device comprising the liquid jet head according to <7>; and a containing section adapted to contain the liquid.

What is claimed is:

1. A head chip adapted to jet liquid comprising:

an actuator plate having a plurality of ejection grooves arranged side by side in a first direction, a plurality of non-ejection grooves arranged side by side along the first direction, and individual electrodes respectively formed in the plurality of non-ejection grooves;

a nozzle plate having a plurality of nozzle holes individually communicated with the plurality of ejection grooves; and a cover plate adapted to cover the actuator plate, wherein the cover plate has interconnection connecting sections respectively disposed in end part areas along a second direction perpendicular to the first direction, and adapted to electrically connect a plurality of individual interconnections electrically connected to the individual electrodes to an interconnection board outside the head chip, the plurality of individual interconnections in the interconnection connecting section has a bend part extending in an oblique direction crossing the second direction so as to circumvent a predetermined obstacle, and a connection area between the plurality of individual interconnections and the interconnection board in the interconnection connecting section is an area including the bend part.

2. The head chip according to claim 1, wherein the plurality of individual interconnections in the interconnection connecting section further includes a straight part extending along the second direction, and the connection area in the interconnection connecting section is an area including both of the bend part and the straight part.

3. The head chip according to claim 1, wherein the plurality of individual interconnections is disposed on both sides of the obstacle along the first direction in the interconnection connecting section, and a bend angle as an acute angle formed by the oblique direction with respect to the second direction gradually decreases as a distance along the first direction from the obstacle to the individual interconnection increases in the interconnection connecting section.

4. The head chip according to claim 1, wherein as alignment marks for performing alignment between the plurality of individual interconnections and the interconnection board, there are disposed a first alignment mark disposed in an end part area along the first direction in the cover plate, and having a shape obtained by chamfering a corner part in a rectangular shape, and a second alignment mark disposed on the interconnection board, and having a cross-like shape.

5. The head chip according to claim 4, wherein the first alignment mark has an octagonal shape having a longitudinal direction.

6. The head chip according to claim 1, wherein common electrodes are respectively formed in the plurality of ejection grooves, a common interconnection is electrically connected to the common electrodes, and the obstacle is one of a through hole and a cutout part adapted to electrically connect the common interconnection in the interconnection connecting section.

7. A liquid jet head comprising the head chip according to claim 1.

8. A liquid jet recording device comprising:

the liquid jet head according to claim 7; and a containing section adapted to contain the liquid.

* * * * *